US009268287B2

(12) United States Patent
Maruyama et al.

(10) Patent No.: US 9,268,287 B2
(45) Date of Patent: Feb. 23, 2016

(54) SHEET FEED DEVICE AND IMAGE FORMING APPARATUS

(71) Applicant: KYOCERA Document Solutions Inc., Osaka-shi, Osaka (JP)

(72) Inventors: Kei Maruyama, Osaka (JP); Yoshiyuki Asakawa, Osaka (JP)

(73) Assignee: KYOCERA Document Solutions Inc., Osaka-shi (JP)

( * ) Notice: Subject to any disclaimer, the term of this patent is extended or adjusted under 35 U.S.C. 154(b) by 0 days.

(21) Appl. No.: 14/489,306

(22) Filed: Sep. 17, 2014

(65) Prior Publication Data

US 2015/0084272 A1 Mar. 26, 2015

(30) Foreign Application Priority Data

Sep. 20, 2013 (JP) ..... 2013-195331
Feb. 28, 2014 (JP) ..... 2014-038729

(51) Int. Cl.
*B65H 5/00* (2006.01)
*G03G 15/00* (2006.01)
*G03G 21/16* (2006.01)

(52) U.S. Cl.
CPC ..... *G03G 15/6529* (2013.01); *G03G 15/6514* (2013.01); *G03G 21/1633* (2013.01); *B65H 2402/441* (2013.01); *B65H 2402/45* (2013.01); *B65H 2402/5155* (2013.01); *B65H 2404/144* (2013.01); *B65H 2404/1521* (2013.01); *B65H 2601/11* (2013.01); *B65H 2601/321* (2013.01)

(58) Field of Classification Search
CPC ..... B65H 2402/411; B65H 2402/45; B65H 2402/5155; B65H 2404/144; B65H 2404/1521; B65H 2601/11; B65H 2601/321; G03G 21/1623; G03G 21/1628; G03G 21/1633; G03G 21/1638
See application file for complete search history.

(56) References Cited

U.S. PATENT DOCUMENTS

| | | | | |
|---|---|---|---|---|
| 7,203,448 | B2 * | 4/2007 | Yokoi | 399/124 |
| 2004/0237690 | A1 * | 12/2004 | Masuda et al. | 74/469 |
| 2007/0154238 | A1 * | 7/2007 | Yokoi | 399/124 |
| 2008/0124118 | A1 * | 5/2008 | Ukai et al. | 399/110 |
| 2008/0138111 | A1 * | 6/2008 | Ju et al. | 399/121 |
| 2008/0240780 | A1 | 10/2008 | Yamauchi | |
| 2009/0022514 | A1 * | 1/2009 | Fujiwara et al. | 399/121 |
| 2010/0078884 | A1 | 4/2010 | Uehara | |

FOREIGN PATENT DOCUMENTS

JP 11106093 A 4/1999

OTHER PUBLICATIONS

European Patent Office, Extended European Search Report of EP14184740, Germany, Feb. 4, 2015, 7 pages.

* cited by examiner

*Primary Examiner* — Jeremy R Severson
(74) *Attorney, Agent, or Firm* — Alleman Hall McCoy Russell & Tuttle LLP

(57) ABSTRACT

A sheet feed device of an image forming apparatus includes an outside cover and an inside cover. The outside cover opens and closes a side of a housing. The inside cover is disposed more inside of the housing than the outside cover. Each of the covers is rotatably supported with a lower end thereof as a fulcrum by the housing. A first locking piece is provided in the upper end of the outside cover, and a second locking piece is disposed below the first locking piece. A coupled portion configured to be selectively coupled with the first locking piece or the second locking piece is provided in the inside cover. During the process where the outside cover is rotationally moved in the opening direction, the coupled portion is once released from the coupling with the first locking piece, and then is coupled with the second locking piece.

18 Claims, 18 Drawing Sheets

SHEET FEED DEVICE AND IMAGE FORMING APPARATUS

INCORPORATION BY REFERENCE

This application is based upon and claims the benefit of priority from the corresponding Japanese Patent Application No. 2014-038729 filed on Feb. 28, 2014, and No. 2013-195331 filed on Sep. 20, 2013, the entire contents of which are incorporated herein by reference.

BACKGROUND

The present disclosure relates to a sheet feed device in which an outside cover and an inside cover, which can open and close a housing, are disposed in alignment, and to an image forming apparatus.

A conventional image forming apparatus such as a coppier or a printer, includes a sheet conveying device for extracting a sheet member (print sheet) stored in a sheet feed cassette, and conveying it. The sheet feed device includes a rotating roller that contacts the sheet member. A rotational driving force of a direction is transmitted to the rotating roller from a motor or the like, thereby the sheet member is conveyed along a conveyance path formed inside the image forming apparatus. In this kind of image forming apparatus, a side cover is provided to expose the conveyance path. For example, a typical image forming apparatus includes a cover that is rotatably supported, with its lower end as a fulcrum. With such a side cover provided, when a jamming of a sheet member occurs in the conveyance path, the user can open the side cover to expose the conveyance path, and easily remove the sheet member from the conveyance path.

Meanwhile, in the case where a conveyance path is formed inside an image forming apparatus, if only one side cover is provided to expose the conveyance path, the side cover needs to have a large thickness. However, when the side cover has a larger thickness, the rotational radius around the fulcrum becomes larger, and the image forming apparatus needs to be larger in height. In view of this, to restrict the image forming apparatus from becoming large in height, a plurality of side covers can be aligned between a side surface of the image forming apparatus and the conveyance path.

In the above-mention configuration where a plurality of side covers are aligned, when an outside side cover positioned in the side surface of the image forming apparatus is rotationally moved, an inside side cover needs to be rotationally moved in conjunction with the rotational movement of the outside side cover. As a mechanism for causing the two side covers to be rotationally moved in conjunction with each other, a mechanism is known in which the outside side cover is coupled with the inside side cover by a link member such as a connecting rod.

SUMMARY

A sheet feed device according to an aspect of the present disclosure includes a housing, a sheet storing portion, a conveyance path, an outside cover, and an inside cover. The sheet storing portion is configured to store one or more sheet members. The conveyance path is formed inside the housing and configured to guide a sheet member conveyed from the sheet storing portion. The outside cover is rotatably supported with a lower end thereof as a fulcrum by the housing, and configured to be positioned at a first closing position to close the side of the housing, and at a first opening position to open the side of the housing. The inside cover is disposed more inside of the housing than the outside cover and rotatably supported with a lower end thereof as a fulcrum by the housing, and configured to be rotationally moved between a second closing position at which to close the conveyance path when the outside cover is at the first closing position, and a second opening position at which to expose the conveyance path when the outside cover is at the first opening position. A coupled portion is provided on the inside cover. The coupled portion is configured to be coupled with the outside cover. A first coupling portion and a second coupling portion are provided on the outside cover. The first coupling portion is configured to, when the outside cover is rotationally moved in an opening direction from the first closing position toward the first opening position, be coupled with the coupled portion and cause the inside cover to be rotationally moved toward the second opening position, and after the inside cover starts to be rotationally moved toward the second opening position, release coupling with the coupled portion. The second coupling portion is configured to, when the outside cover is further rotationally moved toward the first opening position after the first coupling portion releases the coupling with the coupled portion, be coupled with the coupled portion and hold the outside cover at the first opening position.

An image forming apparatus according to another aspect of the present disclosure includes a housing, an outside cover, and an inside cover. The outside cover is rotatably supported with a lower end thereof as a fulcrum by the housing, and configured to be positioned at a first closing position to close the side of the housing, and at a first opening position to open the side of the housing. The inside cover is disposed more inside of the housing than the outside cover and rotatably supported with a lower end thereof as a fulcrum by the housing, and configured to be rotationally moved between a second closing position at which to close inside of the housing when the outside cover is at the first closing position, and a second opening position at which to open the inside of the housing when the outside cover is at the first opening position. A coupled portion is provided on the inside cover. The coupled portion is configured to be coupled with the outside cover. A first coupling portion and a second coupling portion are provided on the outside cover. The first coupling portion is configured to, when the outside cover is rotationally moved in an opening direction from the first closing position toward the first opening position, be coupled with the coupled portion and cause the inside cover to be rotationally moved toward the second opening position, and after the inside cover starts to be rotationally moved toward the second opening position, release coupling with the coupled portion. The second coupling portion is configured to, when the outside cover is further rotationally moved toward the first opening position after the first coupling portion releases the coupling with the coupled portion, be coupled with the coupled portion and hold the outside cover at the first opening position.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

BRIEF DESCRIPTION OF THE DRAWINGS

FIG. 6A shows the closing position where the outside cover and the inside cover are closed with respect to the housing; and FIG. 6B shows the state where the outside cover and the inside cover are rotationally moved slightly from the closing position.

FIG. 7A shows the state where the coupling between the outside cover and the inside cover is released; and FIG. 7B shows the opening position where the outside cover and the inside cover are completely opened with respect to the housing.

FIG. 8A shows the state where the outside cover and the inside cover are at the opening position and the coupling between them is released; and FIG. 8B shows the state where the outside cover is rotationally moved at maximum.

FIG. 12A is a perspective view; and FIG. 12B is a cross-sectional view.

FIG. 13A is a cross-sectional perspective view; and FIG. 13B is a cross-sectional view.

FIG. 14A is a cross-sectional perspective view; and FIG. 14B is a cross-sectional view.

FIG. 16A is a perspective view; and FIG. 16B is an enlarged perspective view.

FIG. 17A is a perspective view; and FIG. 17B is a cross-sectional view.

DETAILED DESCRIPTION

Figure 1:
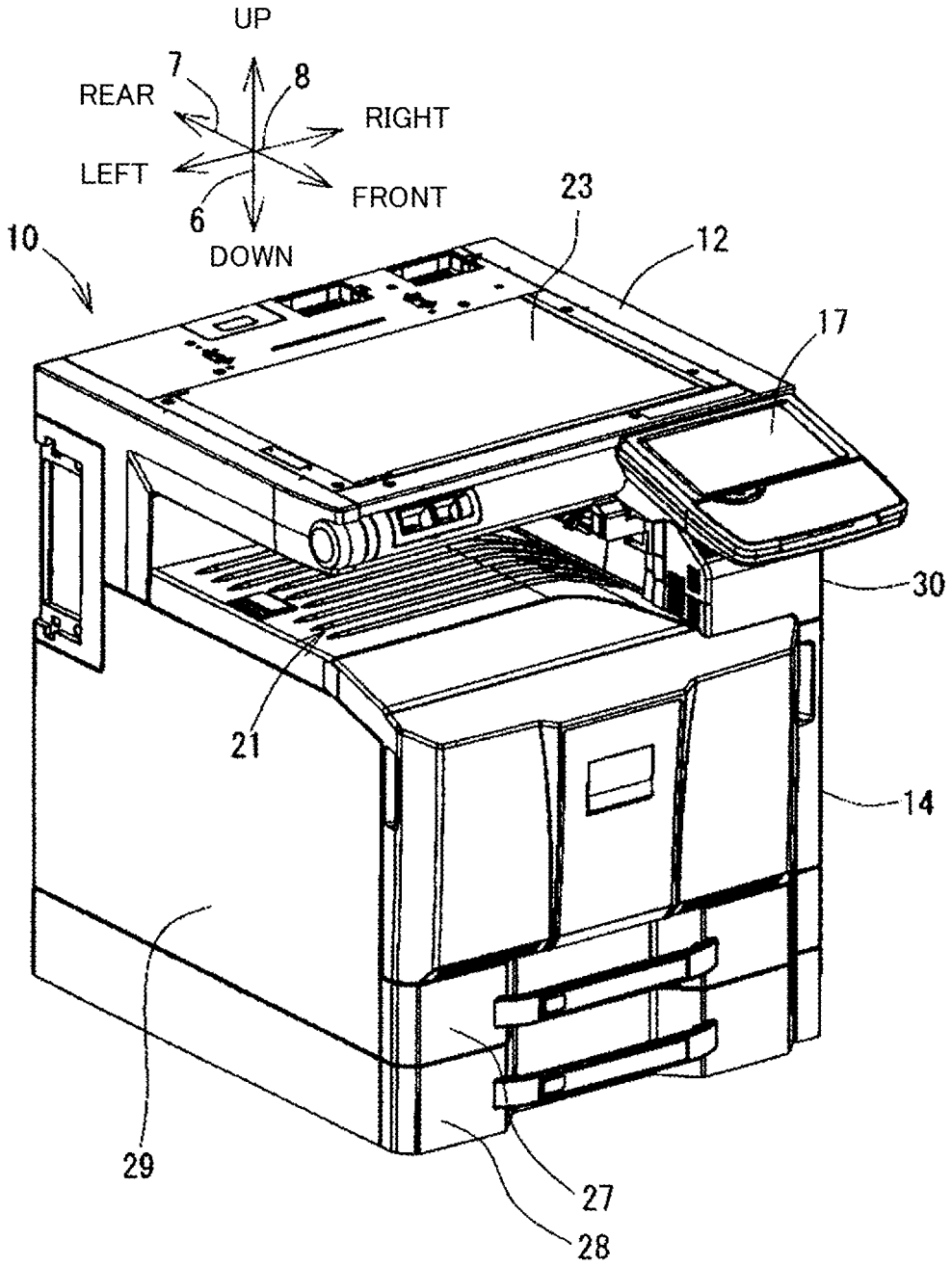
FIG. 1 is a perspective view showing the configuration of an image forming apparatus according to a first embodiment of the present disclosure.

The following describes an image forming apparatus 10 according to the first embodiment of the present disclosure. It is noted that for the sake of explanation, an up-down direction 6 is defined as the vertical direction in the state (state shown in FIG. 1) where the image forming apparatus 10 is installed on a flat surface. In addition, a front-rear direction 7 is defined on the supposition that a surface on which an operation display panel 17 is provided is the front surface (front side). Furthermore, a left-right direction 8 is defined based on the front surface of the image forming apparatus 10. It is noted that embodiments described in the following are merely concrete examples of the present disclosure, and are not intended to limit the technical scope of the present disclosure.

First, an outlined configuration of the image forming apparatus 10 will be described with reference to FIGS. 1 through 3. The image forming apparatus 10 is a so-called "in-body discharge type" multifunction peripheral, and has various functions such as a printer, a copier, a facsimile, a scanner, and the like. The image forming apparatus 10 forms an image of an input image onto a print sheet P (an example of the sheet member of the present disclosure) by using a print material such as toner. Note that the image forming apparatus 10 is not limited to a multifunction peripheral, and the present disclosure is also applicable to a specialized device such as a printer, a copier, a facsimile or the like.

The image forming apparatus 10 includes an image reading portion 12 and an image forming portion 14. The image reading portion 12 performs a process of reading an image from a document sheet, and is provided in the upper portion of the image forming apparatus 10. The image forming portion 14 performs a process of forming an image based on the electrophotography, and is disposed below the image reading portion 12. The image forming portion 14 includes two sheet feed devices 27 and 28 that are arranged as two tiers in the vertical direction. The sheet feed device 27, the upper one of the two sheet feed devices, is integrally formed with a housing 29 in the lowest portion of the image forming portion 14. The sheet feed device 28, the lower one of the two sheet feed devices, is extension-type and is attached to the bottom surface of the housing 29 of the image forming portion 14 as an option device. The sheet feed device 28 is configured to be attachable/dechable to/from the bottom surface of the housing 29. In addition, a paper sheet discharge portion 30 is provided on the right side of the image forming portion 14. It is noted that the image forming method of the image forming portion 14 is not limited to the electrophotography, but may be an inkjet recording method or other recording or printing methods.

Above the image forming portion 14, a sheet discharge space 21, into which print sheets are discharged, is provided. The paper sheet discharge portion 30 is provided such that it couples the image forming portion 14 with the image reading portion 12, with the sheet discharge space 21 formed between the image forming portion 14 and the image reading portion 12. In the present embodiment, as shown in FIG. 1, the front side and the left side of the sheet discharge space 21 are opened. In addition, the rear side and the right side of the sheet discharge space 21 are not opened. The rear side is closed, and on the right side, the paper sheet discharge portion 30 is provided.

Figure 2:
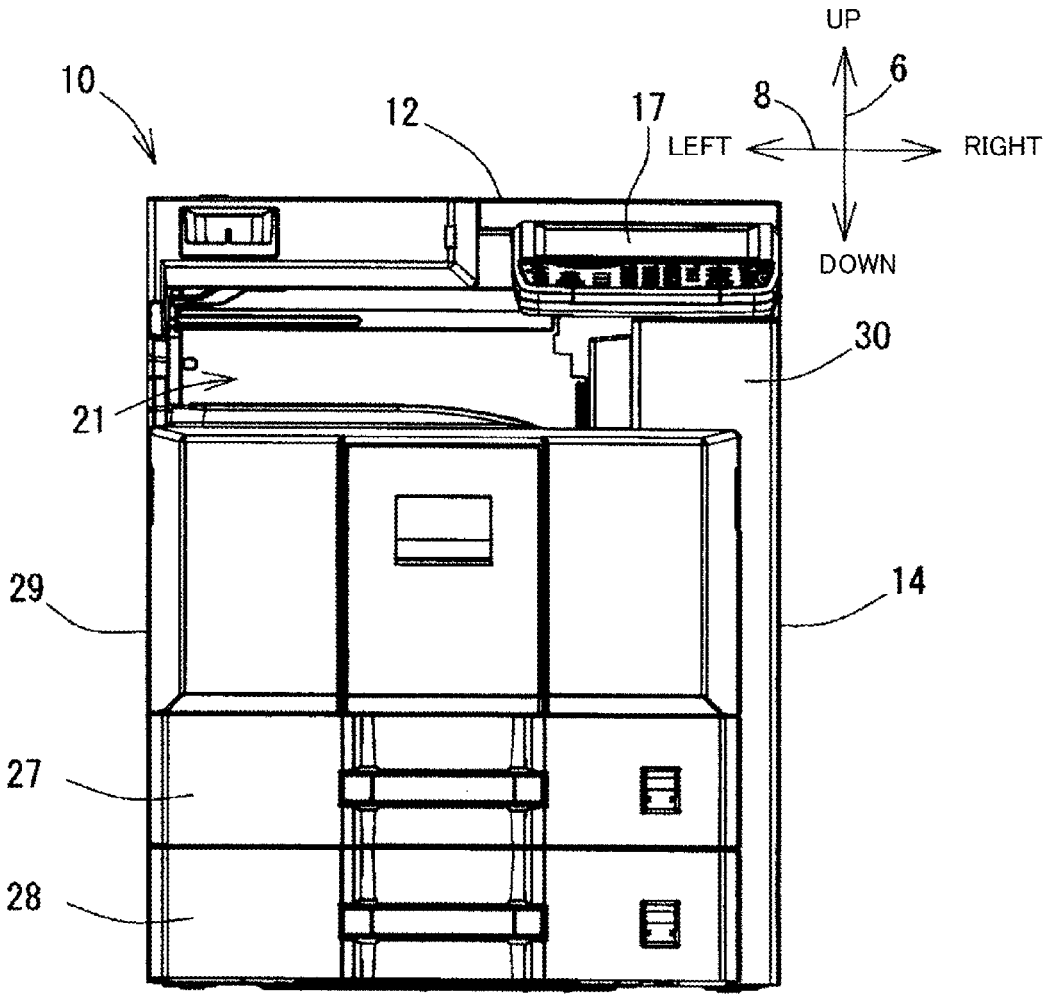
FIG. 2 is a front view showing the configuration of the image forming apparatus of FIG. 1.

As shown in FIG. 1, the image reading portion 12 includes a document sheet placing table 23. When the image forming apparatus 10 functions as a copier, a document sheet is set on the document sheet placing table 23, and when the image forming apparatus 10 functions as a copier, a document sheet is set on the document sheet placing table 23, and after a document sheet cover 24 is closed, a copy start instruction is input from an operation display panel 17. This causes the image reading portion 12 to start the reading operation to read the image data of the document sheet. The read image data is sent to the image forming portion 14. It is noted that in FIGS. 1 and 2, the document sheet cover 24 is omitted (see FIG. 3).

Figure 3:
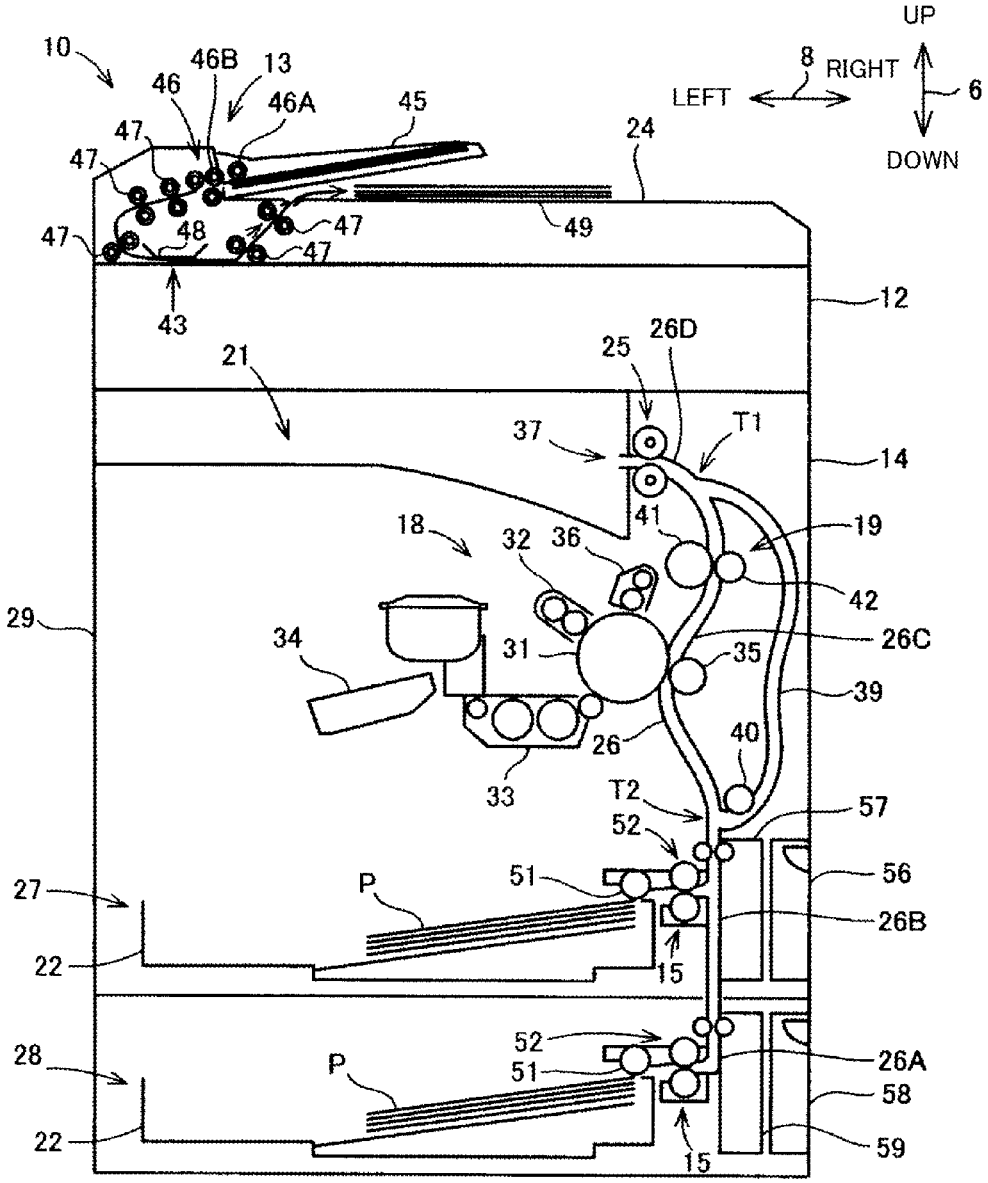
FIG. 3 is a front view showing the internal configuration of the image forming apparatus of FIG. 1.

In addition, as shown in FIG. 3, the image reading portion 12 includes an ADF 13. The ADF 13 is provided in the document sheet cover 24. The ADF 13 is an automatic document sheet feeding device and includes a document sheet tray 45, a conveying mechanism 46, a plurality of conveying rollers 47, a paper sheet pressing 48, a sheet discharge portion 49, and the like. The ADF 13 drives motors (not shown) to drive the conveying mechanism 46 and the conveying rollers 47, thereby causing a document sheet set on the document sheet tray 45 to pass a reading position 43 provided on the document sheet placing table 23, and to be conveyed to the sheet discharge portion 49. The conveying mechanism 46 includes a feeding roller 46A and a conveying roller 46B. The feeding roller 46A feeds the document sheet, and the conveying roller 46B conveys the document sheet fed by the feeding roller 46A. The document sheet is fed from the document sheet tray 45 by the feeding roller 46A, and is conveyed by the conveying roller 46B toward the downstream side in the conveying direction. The document sheet is further conveyed by a conveying roller 47 that is provided on the downstream side in the conveying direction. The image of the document sheet is read by the image reading portion 12 when the document sheet passes the reading position 43 during the document sheet conveying process performed by the ADF 13.

The image forming portion 14 forms an image on a print sheet P based on the image data which has been read by the image reading portion 12 or input from the outside, wherein the print sheet P has a specific size such as A-size or B-size. In the present embodiment, as described below, the image forming portion 14 can discharge the print sheet P, on one side of which an image has been formed, into a sheet discharge space 21, or switch back and send the print sheet P into a reverse conveyance path 39 so that an image can be formed on the reverse side of the print sheet P.

As shown in FIG. 3, the image forming portion 14 mainly includes sheet feed devices 27, 28, an image transfer portion 18 that is based on the electrophotography, a fixing portion 19, a control portion (not shown) for totally controlling the image forming portion 14, or the like. In addition, the image forming portion 14 includes a conveying motor and a discharge motor (both not shown). These portions are provided inside the housing 29 that constitutes the outer frame cover, the internal frame and the like of the image forming portion 14.

The sheet feed devices 27, 28 convey the sheet member to the image transfer portion 18. Each of the sheet feed devices 27, 28 includes a paper sheet storing portion 22 (an example of the sheet storing portion of the present disclosure) that is in the shape of a tray, and a conveying mechanism 15. The paper sheet storing portion 22 stores a stack of print sheets P (the print sheets P used for image formation) on which images are to be formed by the image transfer portion 18. The conveying mechanism 15 picks up and conveys, one by one, the print sheets P stored in the paper sheet storing portion 22. The conveying mechanism 15 is provided on the upper side of the right-end part of the paper sheet storing portion 22. The conveying mechanism 15 includes a feeding roller 51 and a pair of conveying rollers 52. When an instruction to convey a print sheet P is input into the image forming apparatus 10, the conveying motor is driven and rotated. This causes the feeding roller 51 and the pair of conveying rollers 52 to rotate. The print sheet P is fed from the paper sheet storing portion 22 by the feeding roller 51, and is conveyed toward the downstream side in the conveying direction by the pair of conveying rollers 52.

As shown in FIG. 3, in the image forming portion 14, a vertical conveyance path 26 is formed to extend upward from the pair of conveying rollers 52. The vertical conveyance path 26 is formed in the right-side portion of the housing 29, and extends in the up-down direction 6 along the right side surface. In the following description, the vertical conveyance path 26 is divided into a first conveyance path 26A, a second conveyance path 26B, a third conveyance path 26C, and a fourth conveyance path 26D. The first conveyance path 26A is formed in the sheet feed device 28. The second conveyance path 26B is formed in the sheet feed device 27. The third conveyance path 26C is formed in a section extending from a merge point T2, which is described below and is near the end of the second conveyance path 26B, to a branch point T1 which is described below. The fourth conveyance path 26D is formed in a section extending from the branch point T1 to the sheet discharge space 21.

Furthermore, the sheet feed device 27 includes an outside cover 56 and an inside cover 57. The outside cover 56 and the inside cover 57 are provided at the right end of the sheet feed device 27. The outside cover 56 and the inside cover 57 are rotatably supported by the housing 29. In the present embodiment, when the outside cover 56 is opened from the closing position shown in FIG. 3, the inside cover 57 is opened in conjunction with the opening operation of the outside cover 56. This causes the second conveyance path 26B in the sheet feed device 27 to be exposed. It is noted that the sheet feed device 28 also includes an outside cover 58 and an inside cover 59 in a similar manner to the sheet feed device 27. The configuration of the outside cover 56 and the inside cover 57 is described below.

Above the sheet feed device 27, the image transfer portion 18 is provided. The image transfer portion 18 performs an image transfer process onto the print sheet P conveyed from the sheet feed devices 27, 28. Specifically, the image transfer portion 18 transfers, based on the input image data, a toner image onto the print sheet P using a print material such as toner. As shown in FIG. 3, the image transfer portion 18 includes a photoconductor drum 31, a charging portion 32, a developing portion 33, an LSU (Laser Scanning Unit) 34, a transfer roller 35, and a cleaning portion 36.

The photoconductor drum 31 is provided on the left side of the third conveyance path 26C. When the image forming operation is started, the charging portion 32 charges the surface of the photoconductor drum 31 uniformly into a certain potential. In addition, the LSU 34 scans the photoconductor drum 31 by laser light based on the image data. This results in an electrostatic latent image formed on the photoconductor drum 31. The developing portion 33 then causes the toner to adhere to the electrostatic latent image, and a toner image is formed on the photoconductor drum 31. The transfer roller 35 is provided on the right side of the third conveyance path 26C, and is disposed to face the photoconductor drum 31 across the third conveyance path 26C. When the print sheet P conveyed in the third conveyance path 26C passes through a nip portion between the transfer roller 35 and the photoconductor drum 31, the toner image is transferred onto the print sheet P by the transfer roller 35. The print sheet P with the toner image transferred thereon is conveyed in the third conveyance path 26C to the fixing portion 19 that is disposed on the downstream side of (i.e., above) the image transfer portion 18 in the conveyance direction of the print sheet P.

The fixing portion 19 fixes the toner image transferred on the print sheet P to the print sheet P by heat. The fixing portion 19 includes a heating roller 41 and a pressure roller 42. The pressure roller 42 is biased toward the heating roller 41 by an elastic member such as a spring. As a result, the pressure roller 42 is brought into pressure contact with the heating roller 41. During the fixing operation, the heating roller 41 is heated to a high temperature by a heating means such as a heater. When the print sheet P passes through the fixing portion 19, the toner forming the toner image is heated and fused by the heating roller 41, and the print sheet P is pressed by the pressure roller 42. As a result, the toner is fixed to the print sheet P by the fixing portion 19. That is, the toner image is fixed to the print sheet P, and an image is formed on the print sheet P.

At the end of the fourth conveyance path 26D of the vertical conveyance path 26, a paper sheet discharge outlet 37, through which the print sheet P is discharged, is provided. A section near the end of the vertical conveyance path 26, more specifically, the fourth conveyance path 26D extending from the branch point T1 to the paper sheet discharge outlet 37 is curved from the vertical direction to the horizontal direction, wherein the branch point T1 is positioned on the downstream side of the fixing portion 19. In the vicinity of the paper sheet discharge outlet 37, a pair of discharge rollers 25, which are configured to be rotated in dual directions by a discharge motor (not shown), are provided. The print sheet P having been passed through the fixing portion 19 and conveyed to the fourth conveyance path 26D is conveyed from the paper sheet discharge outlet 37 toward the sheet discharge space 21 by the pair of discharge rollers 25 that are rotated in the forward direction by the discharge motor.

When the single side printing is performed in the image forming portion 14, a print sheet P, with a toner image transferred on a side thereof by the image transfer portion 18, is passed through the fixing portion 19, conveyed in the fourth conveyance path 26D, and discharged from the paper sheet discharge outlet 37 outward.

On the other hand, when the double side printing is performed in the image forming portion 14, first a print sheet P with an image formed on a side thereof is passed through the fixing portion 19, and then conveyed in the fourth conveyance path 26D in the reverse direction into a reverse conveyance path 39. Specifically, the pair of discharge rollers 25 are stopped in the state where the front end of the print sheet P, with an image formed on a side thereof, is exposed from the paper sheet discharge outlet 37 to outside. At this time, the rear end of the print sheet P is held in the state where it is nipped by the pair of discharge rollers 25 near the paper sheet discharge outlet 37. Then, the pair of discharge rollers 25 are rotated in the reverse direction by the reverse rotation driving of the discharge motor (not shown). This causes the print sheet P to be conveyed in the fourth conveyance path 26D in the reverse direction. That is, the print sheet P is conveyed backward in the fourth conveyance path 26D. As shown in FIG. 3, the reverse conveyance path 39, branched from the fourth conveyance path 26D, is formed in the image forming portion 14. The reverse conveyance path 39 merges with the third conveyance path 26C at the merge point T2, which is positioned on the upstream side in the conveyance direction of the print sheet P when viewed from the image transfer portion 18 side. That is, the reverse conveyance path 39 extends from the branch point T1 to the merge point T2. The reverse conveyance path 39 is formed on the right side of the vertical conveyance path 26 in the housing 29. The reverse conveyance path 39 extends in the up-down direction 6 (vertical direction) to be approximately in parallel with the vertical conveyance path 26.

The print sheet P having been conveyed from the fourth conveyance path 26D into the reverse conveyance path 39 is guided downward in the reverse conveyance path 39. In the reverse conveyance path 39, a conveying roller 40 is provided in the vicinity of the merge point T2. The print sheet P having been guided downward in the reverse conveyance path 39 is sent into the vertical conveyance path 26 again by the conveying roller 40 provided immediately before the merge point T2. The print sheet P is then conveyed in the third conveyance path 26C to the image transfer portion 18 again. In the image transfer portion 18, a side of the print sheet P, on which no image has been formed, is set to face the photoconductor drum 31 again. The print sheet P is then passed through the image transfer portion 18 and the fixing portion 19 in sequence, and an image is formed on the opposite side of the print sheet P on which no image has been formed. Subsequently, the print sheet P with images formed on both sides thereof is conveyed in the fourth conveyance path 26D by the pair of discharge rollers 25 that have been returned to the forward rotation, and then discharged into the sheet discharge space 21 from the paper sheet discharge outlet 37.

Figure 4:
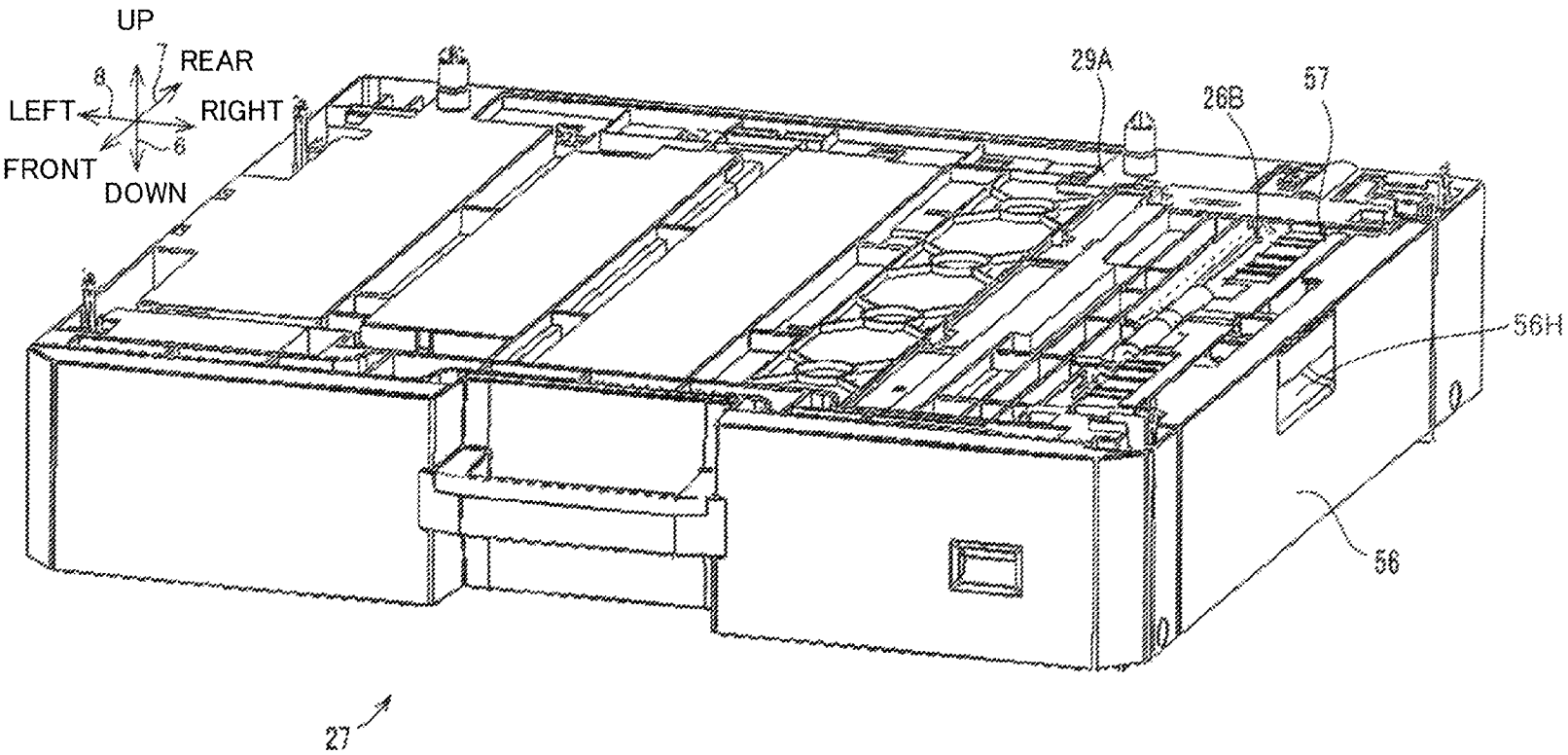
FIG. 4 is a perspective view showing the configuration of a sheet feed device included in the image forming apparatus of FIG. 1.
Figure 5:
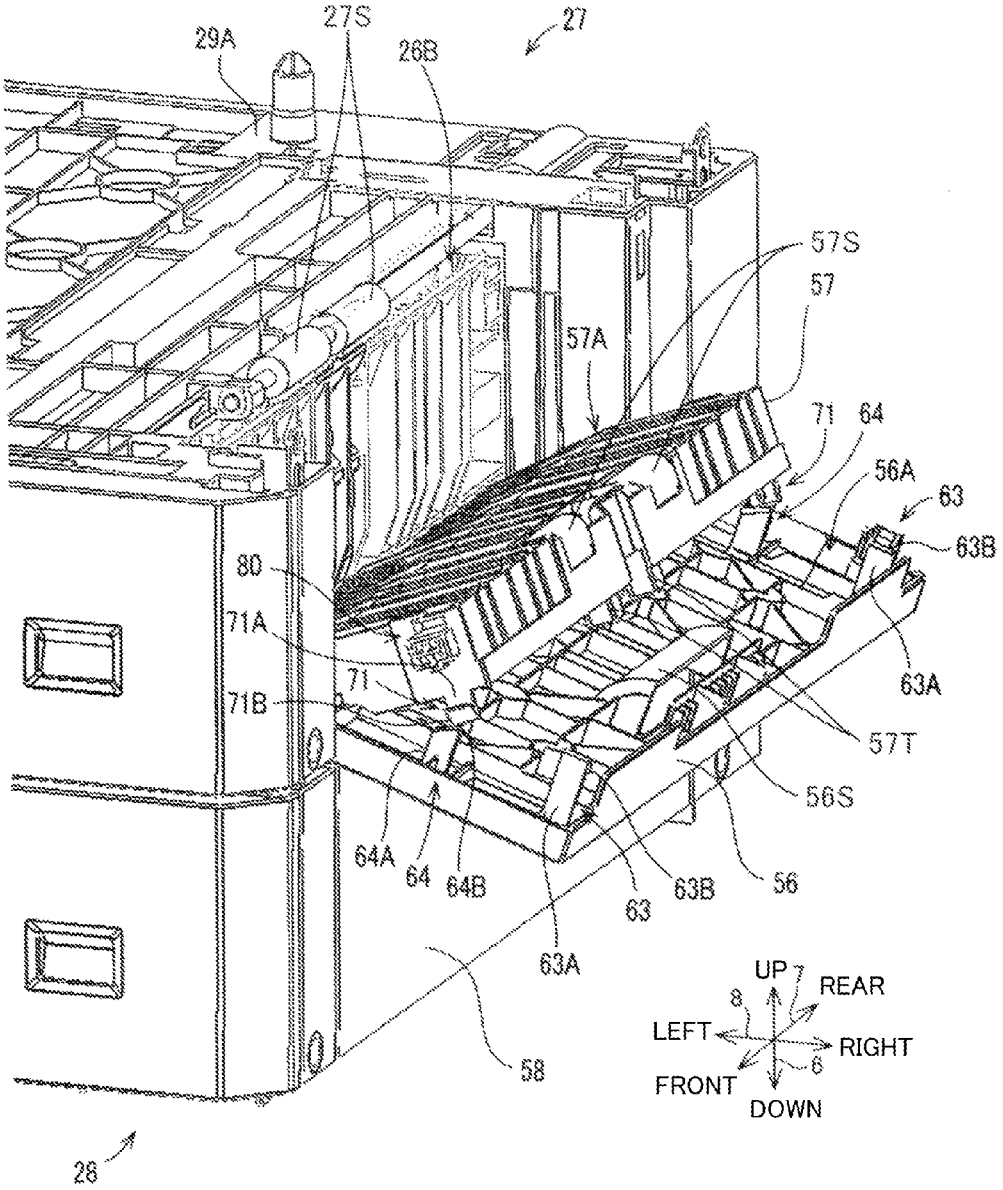
FIG. 5 is a perspective view showing the configuration of the outside cover and the inside cover included in the sheet feed device of FIG. 4.
Figure 6A:
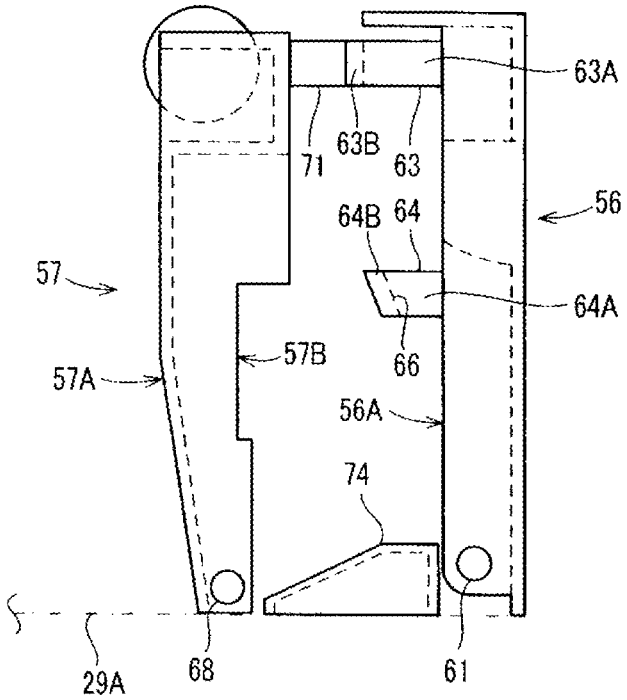
FIGS. 6A and 6B are schematic views showing operation states of the outside cover and the inside cover according to the first embodiment of the present disclosure.
Figure 6B:
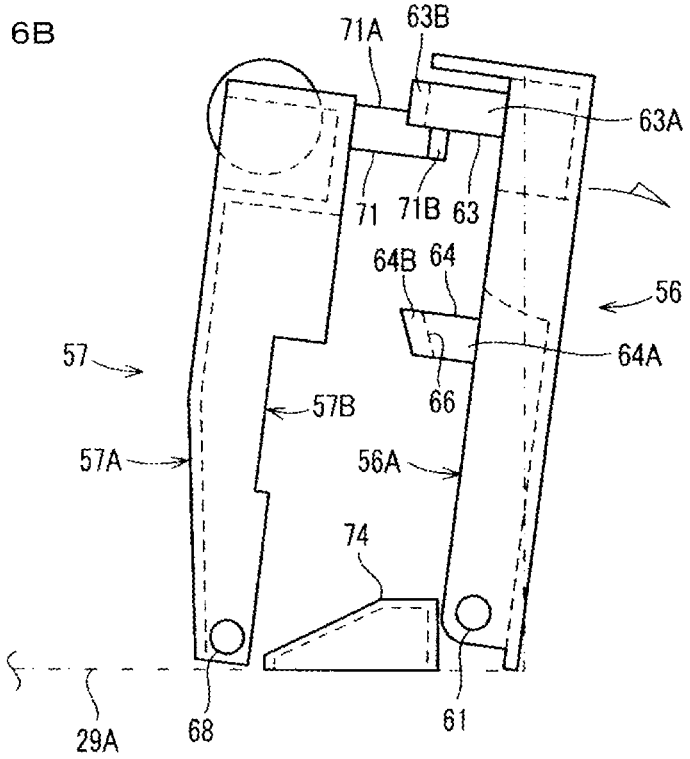

Next, the configuration of the outside cover 56 and the inside cover 57 of the sheet feed device 27 is described with reference to FIGS. 3 through 6B. It is noted that the outside cover 58 and the inside cover 59 of the sheet feed device 28 have the same configuration as the outside cover 56 and the inside cover 57 of the sheet feed device 27. As a result, the same reference numbers assigned to the outside cover 56 and the inside cover 57 of the sheet feed device 27 are assigned to the outside cover 58 and the inside cover 59 of the sheet feed device 28, and detailed description thereof is omitted. Here, FIG. 4 is a perspective view showing the configuration of the sheet feed device 27 extracted from the image forming apparatus 10. FIG. 5 is a perspective view showing the configuration of the sheet feed devices 27, 28 extracted from the image forming apparatus 10. FIGS. 6A and 6B are schematic views showing the configuration and operation of the outside cover 56 and the inside cover 57, with the front-side surfaces of the outside cover 56 and the inside cover 57 being shown. It is noted that, in FIGS. 6A and 6B, a specific drawing of a housing 29A of the sheet feed device 27 is omitted, and only part of the outer frame of the housing 29A is shown by the two-dot chain line.

As shown in FIG. 4, the outside cover 56 and the inside cover 57 are provided at the right end of the sheet feed device 27. The outside cover 56 and the outside cover 58 are both attached to the housing 29A of the sheet feed device 27. Here, the housing 29A of the sheet feed device 27 is a part of the housing 29 of the image forming apparatus 10, and is a part of the housing 29 corresponding to the sheet feed device 27.

The outside cover 56 constitutes the right side of the sheet feed device 27, and as shown in FIG. 4, is formed in the shape of a rectangle that is long in the front-rear direction 7 and short in the up-down direction 6. The outside cover 56 is formed by the injection molding of synthetic resin. The outside cover 56 is rotatably supported by the housing 29A, with the lower end of the outside cover 56 as a fulcrum. The outside cover 56 is supported by the housing 29A such that it can be positioned at a closing position (the first closing position, the position shown in FIGS. 3 and 4) where the right side of the sheet feed device 27 is closed, and at an opening position (the first opening position, the position shown in FIG. 7B) where the right side of the sheet feed device 27 is opened. Rotational shafts 61 as the fulcrum are provided at the lower end of the outside cover 56 at the closing position (see FIGS. 6A and 6B). The rotational shafts 61 are provided respectively at both ends of the outside cover 56 in the front-rear direction 7. The rotational shafts 61 are rotatably supported by the housing 29A.

As shown in FIG. 5, the outside cover 56 includes first locking pieces 63 and second locking pieces 64. The first locking pieces 63 are an example of the first coupling portion of the present disclosure, and the second locking pieces 64 are an example of the second coupling portion of the present disclosure. The first locking pieces 63 and the second locking pieces 64 are respectively coupled with locked pieces 71 (which are described below) included in the inside cover 57 during the opening/closing operation of the outside cover 56.

Two first locking pieces 63 are integrally formed with the outside cover 56. Each first locking piece 63 is formed on an inner surface 56A of the outside cover 56. The inner surface 56A faces the inside cover 57 when the outside cover 56 is at the closing position. The first locking pieces 63 are respectively formed at both ends of the inner surface 56A in the front-rear direction 7. More specifically, the first locking pieces 63 are formed near the edge of the inner surface 56A that is farthest from the rotational shafts 61. Each first locking piece 63 includes an arm 63A and a locking claw 63B (an example of the second locking claw of the present disclosure). The arm 63A is projecting vertically from the inner surface 56A. The locking claw 63B is in a shape of a hook bending from the tip of the arm 63A toward inside in the axis direction (matching the front-rear direction 7) of the rotational shafts 61. The locking claw 63B is coupled with a locking claw 71B of a locked piece 71 that are described below.

Two second locking pieces 64 are integrally formed with the outside cover 56. Each second locking piece 64 is formed on the inner surface 56A of the outside cover 56. The second locking pieces 64 are formed at both ends of the inner surface 56A in the front-rear direction 7. More specifically, the second locking pieces 64 are formed to be between the rotational shafts 61 and the first locking pieces 63 in the inner surface 56A. In other words, the second locking pieces 64 are formed at a position that is more on the rotational shafts 61 side than a position at which the first locking pieces 63 are formed in the inner surface 56A. Each second locking piece 64 includes an arm 64A and a locking claw 64B (an example of the second locking claw of the present disclosure). The arm 64A is projecting vertically from the inner surface 56A. The locking claw 64B is in a shape of a hook bending from the tip of the arm 64A toward inside in the axis direction (matching the front-rear direction 7) of the rotational shafts 61. The locking claw 64B is coupled with a locking claw 71B of a locked piece 71 that are described below.

As shown in FIG. 5, the first locking pieces 63 are formed to be longer than the second locking pieces 64. The lengths of the first locking pieces 63 and the second locking pieces 64 in the projecting direction are elements that are determined based on: the positional relationship between the outside cover 56 and the inside cover 57; the angle of inclination of the outside cover 56 when the second locking pieces 64 are locked to the locked pieces 71; or the like.

As shown in FIGS. 5, 6A and 6B, each locking claw 64B of the second locking pieces 64 has an inclined surface 66 that is inclined in a predetermined direction. The inclined surface 66 is a surface that contacts the locking claw 71B when the locking claw 64B of the second locking piece 64 is locked to the locking claw 71B of the locked piece 71. The inclined surface 66 is inclined toward the rotational shafts 61 with reference to the inner surface 56A of the outside cover 56. As a result, in the space formed by the inclined surface 66 and the inner surface 56A of the outside cover 56, the space on the rotational shafts 61 side is smaller than the space on the first locking pieces 63 side. That is, the first locking pieces 63 side space is larger than the rotational shafts 61 side space.

As shown in FIG. 5, the inside cover 57 is formed in the shape of a rectangle that is long in the front-rear direction 7 and short in the up-down direction 6. Similar to the outside cover 56, the inside cover 57 is formed by the injection molding of synthetic resin. The inside cover 57 is disposed more inside of the sheet feed device 27 than the outside cover 56, that is, more inside of the housing 29A. Specifically, as shown in FIG. 3, the inside cover 57 is disposed at a position between the second conveyance path 26B and the outside cover 56. An inner surface 57A of the inside cover 57, which is a surface of the inside cover 57 on the inner side, functions as a guide surface on the right side of the second conveyance path 26B when the inside cover 57 is at the closing position shown in FIGS. 3 and 4. That is, the inside cover 57 constitutes a conveyance guide on the right side of the second conveyance path 26B.

The inside cover 57 opens and closes the inside of the housing 29A. Specifically, the inside cover 57 is supported by the housing 29A such that the inside cover 57 can be rotationally moved between: a closing position (the second closing position, the position shown in FIGS. 3 and 4) where the second conveyance path 26B formed inside the housing 29A is closed; and an opening position (the second opening position, the position shown in FIG. 5) where the second conveyance path 26B is exposed. Rotational shafts 68 as the fulcrum are provided in the lower end of the inside cover 57 at the closing position (see FIGS. 6A and 6B). In the housing 29A, the rotational shafts 68 are provided at approximately the same height as the rotational shafts 61 of the outside cover 56. The rotational shafts 68 are provided respectively at both ends of the inside cover 57 in the front-rear direction 7. The rotational shafts 68 are rotatably supported by the housing 29A.

As shown in FIG. 5, the inside cover 57 includes locked pieces 71. The locked pieces 71 are an example of the coupled portion of the present disclosure, and are parts that are to be coupled with the outside cover 56. The locked pieces 71 are selectively locked to and coupled with either the first locking pieces 63 or the second locking pieces 64 of the outside cover 56 during the opening/closing operation of the outside cover 56. In the present embodiment, the locked pieces 71 are coupled with the first locking pieces 63 when the outside cover 56 and the inside cover 57 are both at the closing position shown in FIGS. 3 and 4. Furthermore, the locked pieces 71 are locked to and coupled with the second locking pieces 64 when the outside cover 56 and the inside cover 57 are rotationally moved in the opening direction and have reached the opening position shown in FIG. 7B.

Two locked pieces 71 are integrally formed with the inside cover 57. The locked pieces 71 are formed on an outer surface 57B of the inside cover 57. The outer surface 57B (see FIGS. 6A and 6B) is a surface of the inside cover 57 that faces the outside cover 56 when the covers 56 and 57 are at the closing position. The locked pieces 71 are formed at both ends of the outer surface 57B in the front-rear direction 7. Each locked piece 71 includes an arm 71A and a locking claw 71B (an example of the first locking claw of the present disclosure). The arm 71A is projecting vertically from the outer surface 57B. The locking claw 71B is in a shape of a hook bending from the tip of the arm 71A toward outside (the side opposite to the locking claws 63B and 64B) in the axis direction (matching the front-rear direction 7) of the rotational shafts 68. The locking claw 71B is locked to a locking claw 63B of a first locking piece 63, or a locking claw 64B of a second locking piece 64.

As shown in FIG. 5, lock members 80 are provided at both ends of the inside cover 57 in the front-rear direction 7. The lock members 80 are coupled with projections (not shown) formed in the housing 29A, and hold the inside cover 57 at the closing position. Each lock member 80 includes a lock piece and an elastic member. The lock piece can be displaced in the front-rear direction 7. The elastic member biases the lock piece by the elastic force toward the outside. When the inside cover 57 is rotationally moved toward the closing position, the projections of the housing 29A contact the lock pieces of the lock members 80, and the lock pieces are recessed by the pressure at the contact against the elastic force. Once the inside cover 57 is pushed into the closing position, the lock pieces having passed the projections are returned to the original shapes by the elastic force of the elastic members. This causes the projections of the housing 29A to be engaged with the lock pieces of the lock members 80, and the inside cover 57 is held at the closing position.

The inside cover 57 further includes a pair of driven rollers 57S and projections 57T. The pair of driven rollers 57S are rollers that are rotatably supported by shafts (not shown) at the upper end of the inside cover 57. The pair of driven rollers 57S and a pair of driving rollers 27S, which are rotatably supported by the housing 29A, form the nip portion through which a sheet is conveyed in the second conveyance path 26B. The projections 57T are a pair of projections in a rectangular parallelepiped shape projecting from the upper end of the inside cover 57 toward the outside cover 56. It is noted that a space (not shown) is formed inside each of the projections 57T, and a biasing spring (not shown) is disposed in the space. The biasing springs bias the shafts, which rotatably support the pair of driven rollers 57S, toward the pair of driving rollers 27S. The nip portion is formed stably due to the biasing force of the biasing springs.

On the other hand, the outside cover 56 includes a pressure surface 56S. The pressure surface 56S is a curved surface positioned in rear of a grip portion 56H (see FIG. 4) formed in the outer wall of the outside cover 56.

As shown in FIGS. 6A and 6B, the housing 29A is provided with a supporting portion 74 that supports the inside cover 57. The supporting portion 74, when the inside cover 57 is opened from the closing position and further rotationally moved rightward, abuts the outer surface 57B of the inside cover 57 at a predetermined rotational position, and supports the inside cover 57. That is, the supporting portion 74 restricts the inside cover 57 from being further rotationally moved from the predetermined rotational position. In the present embodiment, the supporting portion 74 supports the inside cover 57 such that the inside cover 57 is held at the rotational position where the locking claw 64B of the second locking piece 64 is locked to the locking claw 71B of the locked piece 71. It is also noted that the supporting portion 74 is a frame member that is extended in the front-rear direction between the lower end of the outside cover 56 and the lower end of the inside cover 57, and constitutes part of the housing 29A (see supporting portion 74R in FIG. 12A).

The following describes the opening/closing operation of the outside cover 56 and the inside cover 57 configured as described above, with reference to FIGS. 6A through 8B.

When both of the outside cover 56 and the inside cover 57 are at the closing position (see FIG. 6A), the inside cover 57 is held at the closing position by the lock members 80. At this time, the locking claws 63B of the first locking pieces 63 are not locked to the locking claws 71B of the locked pieces 71, but are disposed at a position having a predetermined distance from the inner side surfaces of the locking claws 71B. When the outside cover 56 is rotationally moved in the opening direction from this position, the locking claws 63B move toward the inner side surfaces of the locking claws 71B and abut the locking claws 71B. That is, the locking claws 63B of the first locking pieces 63 are locked to the locking claws 71B of the locked pieces 71. This causes the locking claws 63B to be coupled with the locking claws 71B in the opening direction. When the outside cover 56 is further rotationally moved in the opening direction from this position, the locking claws 63B bias the locking claws 71B to pull them toward the opening position. That is, when the outside cover 56 is rotationally moved in the opening direction from the closing position toward the opening position, the locking claws 63B bias the locked pieces 71 in the opening direction. This generates a pulling force that urges the inside cover 57 to be rotationally moved in the opening direction in conjunction with the outside cover 56. When the inside cover 57 is unlocked from the lock members 80 by this pulling force, the inside cover 57 is rotationally moved in the opening direction in conjunction with the opening operation of the outside cover 56 (see FIG. 6B).

As shown in FIG. 6B, during the process in which the outside cover 56 and the inside cover 57 are rotationally moved from the closing position toward the opening position, the locking claws 71B move downward relative to the locking claws 63B. This movement is caused by the rotational shafts 68 of the inside cover 57 being disposed more inside of the housing 29A than the rotational shafts 61 of the outside cover 56. When the outside cover 56 is further rotationally moved in the opening direction, the locking claws 71B are pulled from under the locking claws 63B, and the engagement between the locking claws 71B and the locking claws 63B is released (see FIG. 7A). That is, when the outside cover 56 is rotationally moved in the opening direction, the first locking pieces 63 bias the locked pieces 71 in the opening direction and cause the inside cover 57 to be rotationally moved in the opening direction, and then are disengaged from the locking claws 71B of the locked pieces 71, and the coupling between the locking claws 63B and the locking claws 71B is released. At this time, the inside cover 57 is inclined outward (toward the opening position), and therefore the inside cover 57 is rotationally moved in the opening direction by the weight of the inside cover 57 itself even if it does not receive the pulling force from the outside cover 56.

When the outside cover 56 is further rotationally moved in the opening direction, during the further rotational movement, the locking claws 71B of the locked pieces 71 gradually approach the second locking pieces 64. Then when the inside cover 57 is rotationally moved and reaches the opening position where the outer surface 57B of the inside cover 57 is supported by the supporting portion 74, the locking claws 71B enter the locking claws 64B of the second locking pieces 64, and the locking claws 71B and the locking claws 64B are locked to each other (see FIG. 7B). This causes the locking claws 71B and the locking claws 64B to be coupled with each other in the opening direction. That is, when the locking claws 63B of the first locking pieces 63 are disengaged from the locking claws 71B of the locked pieces 71, the engagement is released, and then the outside cover 56 is further rotationally moved in the opening direction, and the locking claws 64B of the second locking pieces 64 are locked to and coupled with the locking claws 71B of the locked pieces 71. With this coupling, the outside cover 56 is held at the opening position. In the present embodiment, as described above, each locking claw 64B has the inclined surface 66. As a result, in the space formed by the locking claws 64B and the inner surface 56A of the outside cover 56, the opening, which is farther from the rotational shafts 61, is formed broadened. This makes it easier for the locking claws 71B to enter the locking claws 64B.

With the above-described configuration of the outside cover 56 and the inside cover 57, it is possible to open both covers 56, 57 in conjunction with each other by pulling only the outside cover 56 in the opening direction from the state where both the outside cover 56 and the inside cover 57 are at the closing position. In addition, the outside cover 56 is held at the opening position in the state where the inside cover 57 is supported by the supporting portion 74 and the locking claws 71B are coupled with the locking claws 64B. This prevents the outside cover 56 from being rotationally moved unnecessarily. It is noted that, when the outside cover 56 is rotationally moved in the closing direction to close the outside cover 56 and the inside cover 57, the pressure surface 56S formed on the inner surface 56A of the outside cover 56 pushes the projections 57T, which are projecting from the outer surface 57B of the inside cover 57, toward the closing position. This causes the outside cover 56 and the inside cover 57 to be rotationally moved in conjunction with each other toward the closing position.

Figure 7A:
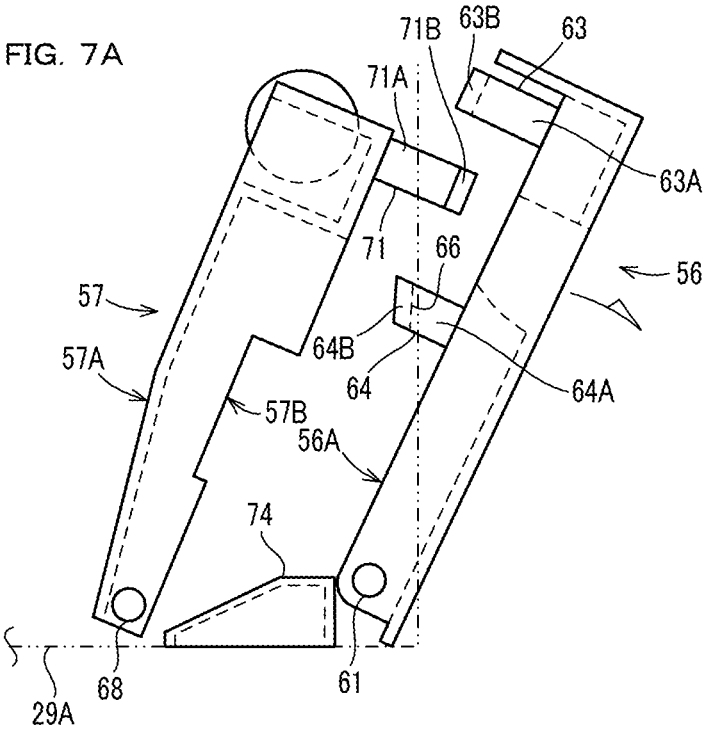
FIGS. 7A and 7B are schematic views showing operation states of the outside cover and the inside cover according to the first embodiment of the present disclosure.
Figure 7B:
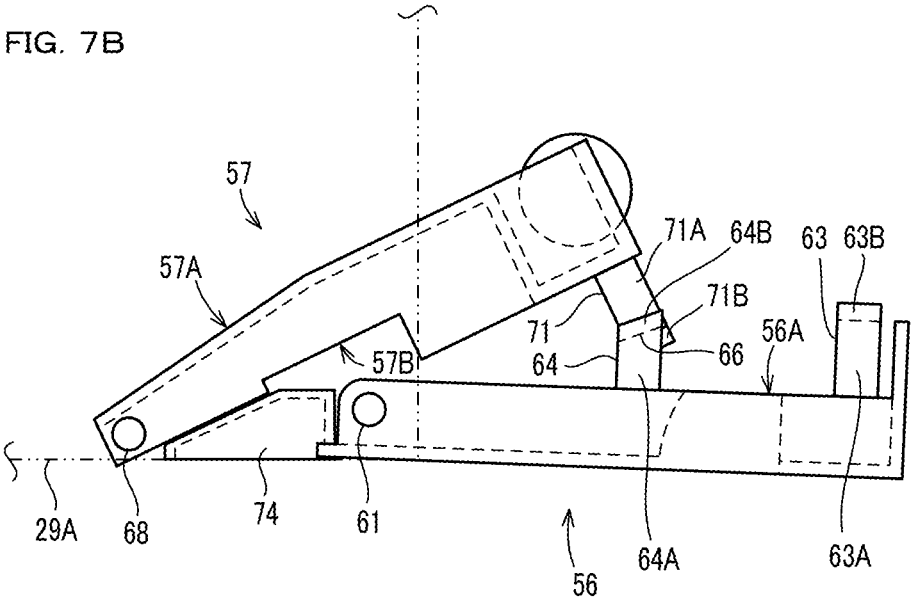
Figure 8A:
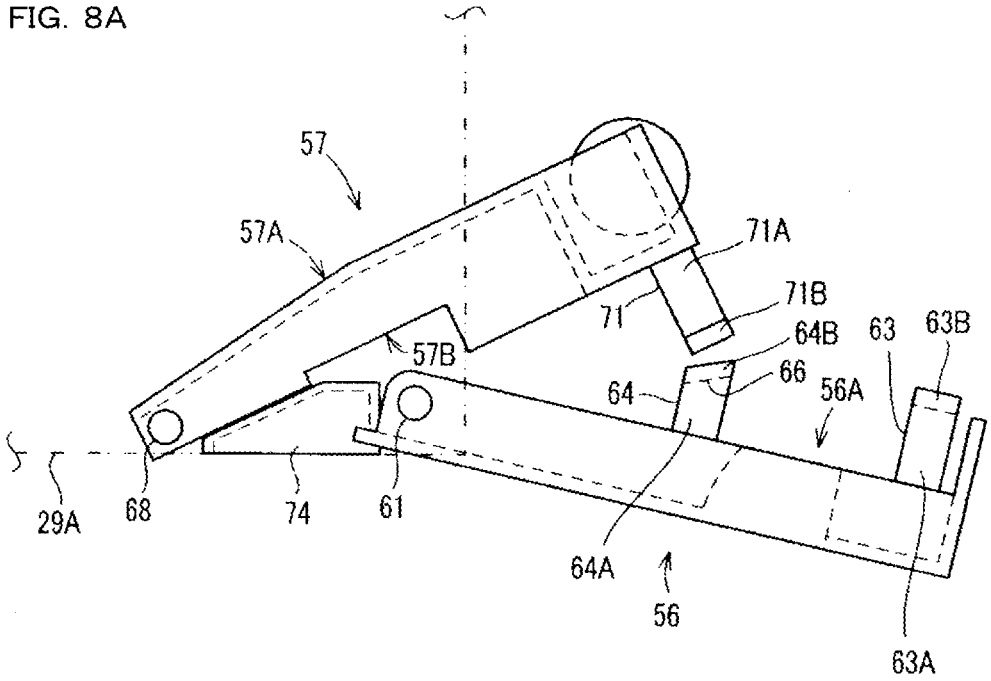
FIGS. 8A and 8B are schematic views showing operation states of the outside cover and the inside cover according to the first embodiment of the present disclosure.

On the other hand, when a strong force is applied downward to the outside cover 56 in the state where the locking claws 71B and the locking claws 64B are locked to and coupled with each other (see FIG. 7B), the coupling between the locking claws 71B and the locking claws 64B is released as shown in FIG. 8A. Specifically, when an external force, which is stronger than the coupling force between the locking claws 71B and the locking claws 64B, is applied in the opening direction to the outside cover 56 held at the opening position, the coupling between the locking claws 71B and the locking claws 64B is released. More specifically, when the external force is applied, the arms 71A of the locked pieces 71 and the arms 64A of the second locking pieces 64 are elastically deformed in opposite directions, and thus the coupling between the locking claws 71B and the locking claws 64B is released. This allows for the outside cover 56 to be rotationally moved in the direction in which the external force was applied, and prevents damage of the locked pieces 71 and the second locking pieces 64.

Figure 8B:
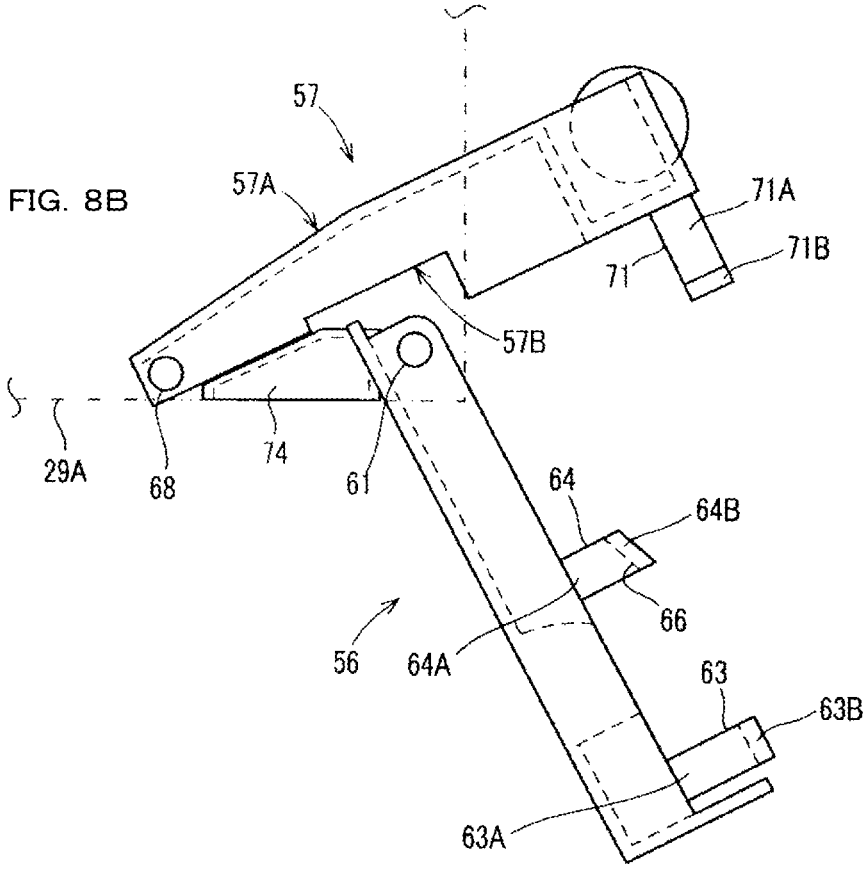
Figure 9:
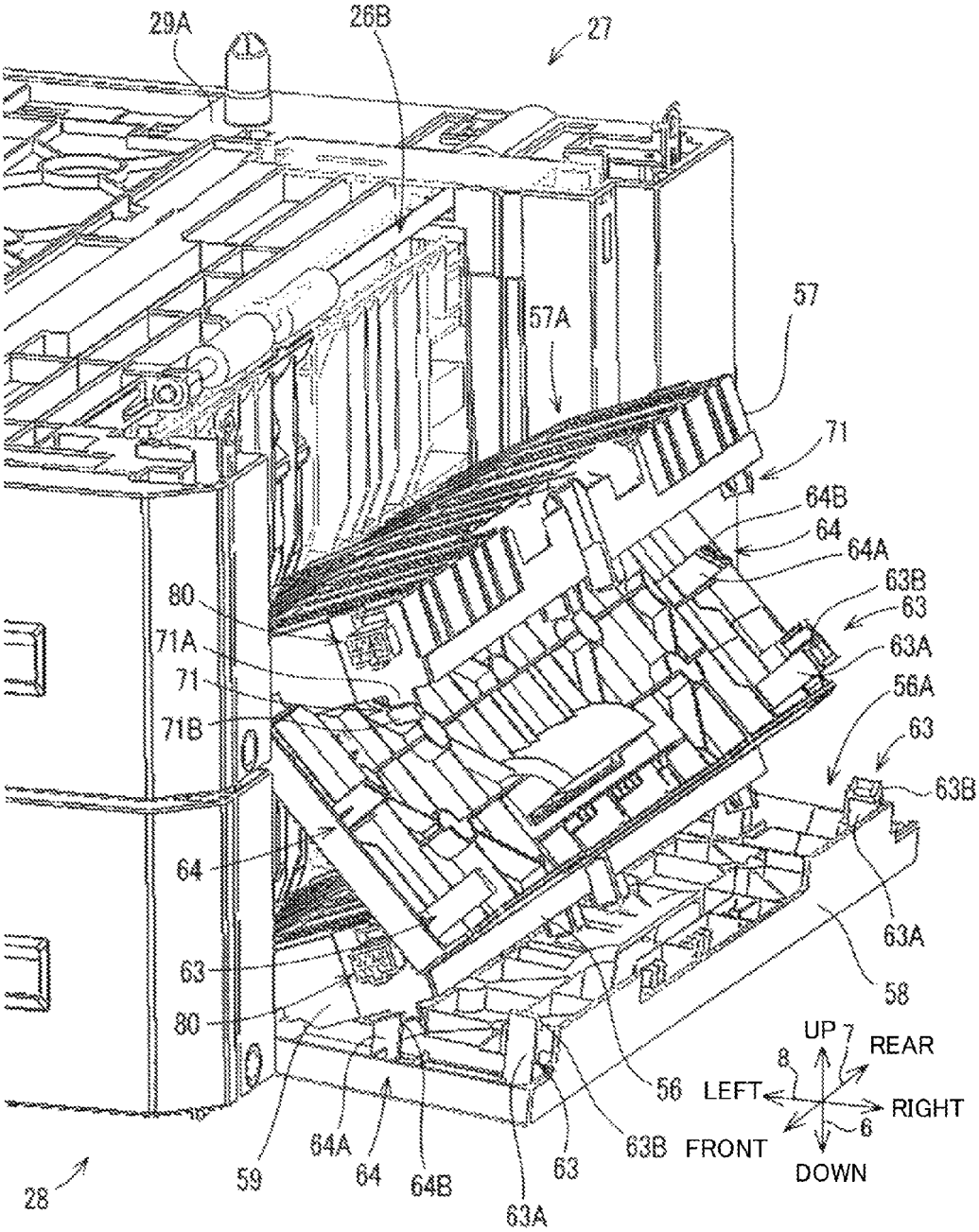
FIG. 9 is a perspective view showing the configuration of the outside cover and the inside cover included in the sheet feed device of FIG. 4.

It is noted that, as shown in FIG. 5, the outside cover 56 is supported in the state where part of an outer surface 56B of the outside cover 56 is abutting the upper end of the outside cover 58 of the sheet feed device 28, which is disposed below the sheet feed device 27. As a result, as shown in FIGS. 5 and 8A, the outside cover 56 is held in a posture where it is slightly inclined downward from the horizontal state. On the other hand, when the outside cover 58 and the inside cover 59 of the sheet feed device 28 are opened, the outer surface 56B of the outside cover 56 is not supported by the upper end of the outside cover 58. In that case, as shown in FIGS. 8B and 9, the outside cover 56 is further rotationally moved to a position where it abuts the outside cover 58 or the inside cover 59 of the sheet feed device 28.

With the above-described configuration of the outside cover 56 and the inside cover 57 of the sheet feed device 27, it is possible to rotationally move both the covers 56, 57 in the opening direction in conjunction with each other by rotationally moving the outside cover 56 in the opening direction from the state where both the outside cover 56 and the inside cover 57 are at the closing position. In addition, when an external force, which is stronger than the coupling force between the locking claws 71B and the locking claws 64B, is applied in the opening direction to the outside cover 56 held at the opening position shown in FIGS. 5 and 7B in the state where the locking claws 71B and the locking claws 64B are engaged with each other, the engagement between the locking claws 71B and the locking claws 64B is released. This prevents damage of the outside cover 56 and the inside cover 57, and prevents damage of the members that are coupling these covers with each other.

In addition, the outside cover 56 and the inside cover 57 are coupled in conjunction with each other by the first locking pieces 63 and the second locking pieces 64 that are integrally formed with the outside cover 56, and by the locked pieces 71 that are integrally formed with the inside cover 57. Therefore, an independent coupling member is not required, and the cost for the parts can be reduced.

In the embodiment described above, the configuration and operation of the outside cover 56 and the inside cover 57 of the sheet feed device 27 are explained. It is noted however that acts and effects similar to those of the outside cover 56 and the inside cover 57 of the sheet feed device 27 are provided by the outside cover 58 and the inside cover 59 of the sheet feed device 28.

In the above embodiment, the image forming apparatus 10 including the sheet feed devices 27, 28 is described as an example of the image forming apparatus of the present disclosure. However, the present disclosure is not limited to this. For example, the sheet feed device of the present disclosure may be realized by the sheet feed device 27 and the sheet feed device 28 included in the image forming apparatus 10. In particular, the sheet feed device 28 as an option device is distributed as a single body independent of the image forming apparatus 10, and thus is suitable for an example of the sheet feed device of the present disclosure.

Figure 10A:
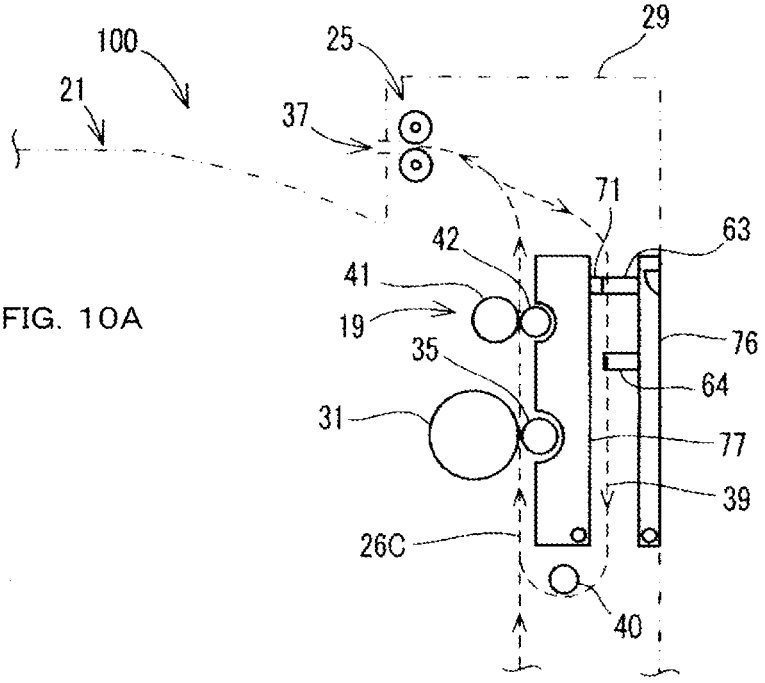
FIGS. 10A and 10B are schematic views showing the configuration of an image forming apparatus according to a second embodiment of the present disclosure.
Figure 10B:
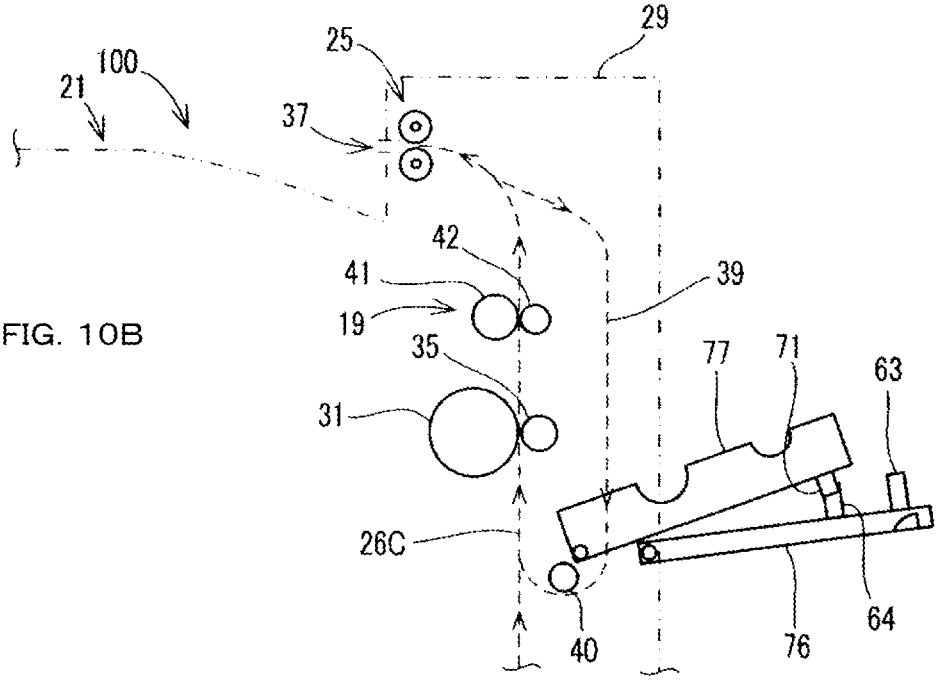

In the above embodiment, the outside cover and the inside cover of the present disclosure are explained as those applied to the sheet feed devices 27, 28. However, the present disclosure is not limited to this. For example, as shown in FIGS. 10A and 10B, the present disclosure is applicable to an image forming apparatus 100 including an outside cover 76 and an inside cover 77, wherein the outside cover 76 has the same configuration as the outside cover 56 and is provided in the right-side portion of the housing 29, and at a more inner position than the outside cover 76, the inside cover 77 having the same configuration as the inside cover 57 is provided. Here, the image forming apparatus 100 has the same configuration as the image forming apparatus 10 except that the outside cover 76 and the inside cover 77 are provided in the right-side portion of the housing 29. As a result, in FIGS. 10A and 10B, the same reference numbers as those assigned to the components of the image forming apparatus 10 represent the same, and detailed description thereof is omitted.

In the image forming apparatus 100, when the outside cover 76 is at the closing position with respect to the housing 29, the outside cover 76 constitutes an outer guide surface of the reverse conveyance path 39. In addition, when the inside cover 77 is at the closing position with respect to the housing 29, the inside cover 77 constitutes an inner guide surface of the reverse conveyance path 39, and constitutes an outer guide surface of the third conveyance path 26C of the vertical conveyance path 26. In this way, even such outside cover 76 and inside cover 77 provide the same acts and effects as the outside cover 56 and inside cover 57 of the sheet feed device 27. That is, rotationally moving the outside cover 76 in the opening direction causes the inside cover 77 to be rotationally moved in conjunction with the outside cover 76. In addition, when an external force, which is stronger than the coupling force, is applied in the opening direction to the outside cover 76 held at the opening position, the coupling between the locking claws 71B and the locking claws 64B is released without any damage.

Figure 11:
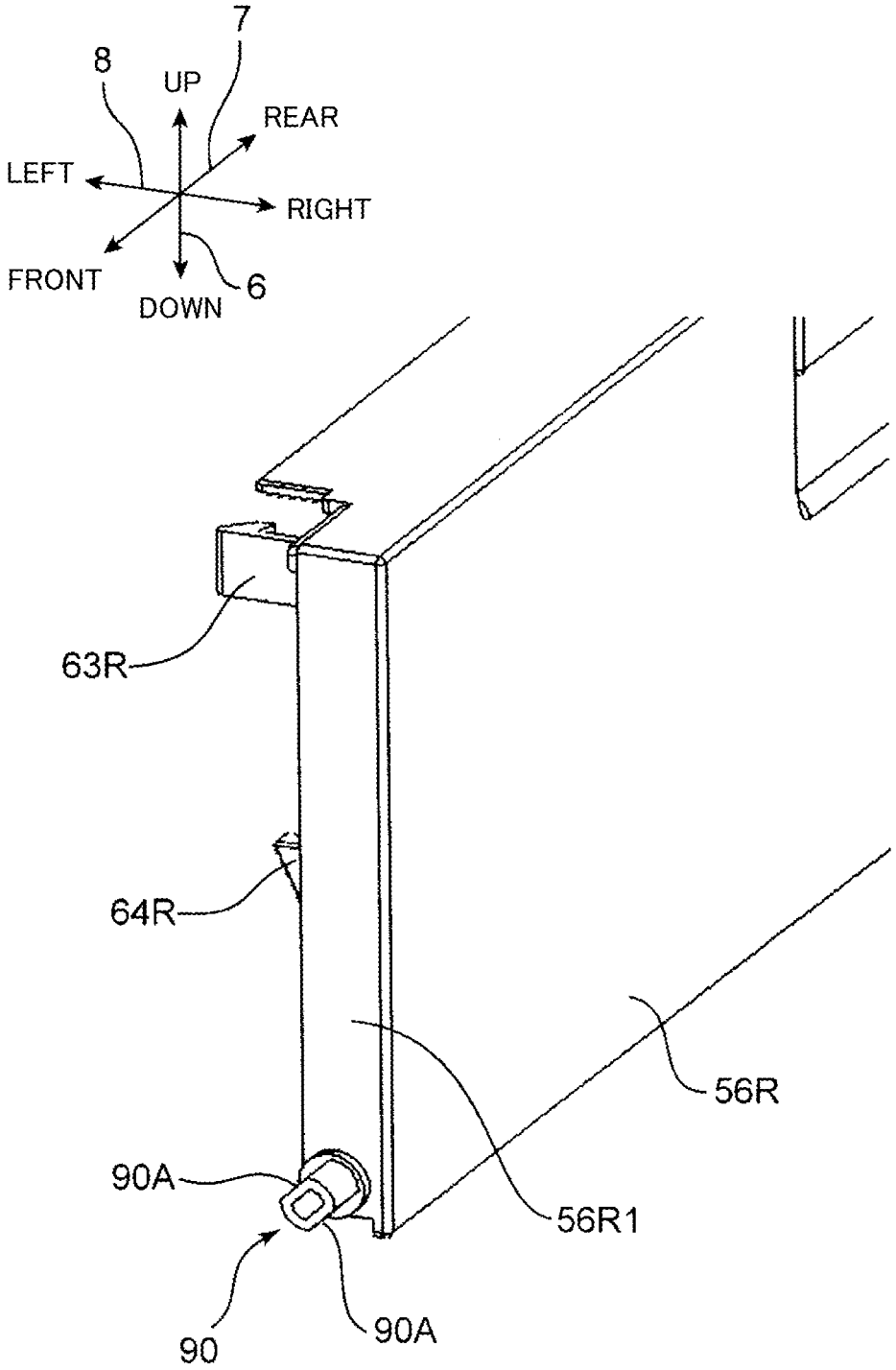
FIG. 11 is a perspective view showing the outside cover of the image forming apparatus according to a third embodiment of the present disclosure.
Figure 13B:
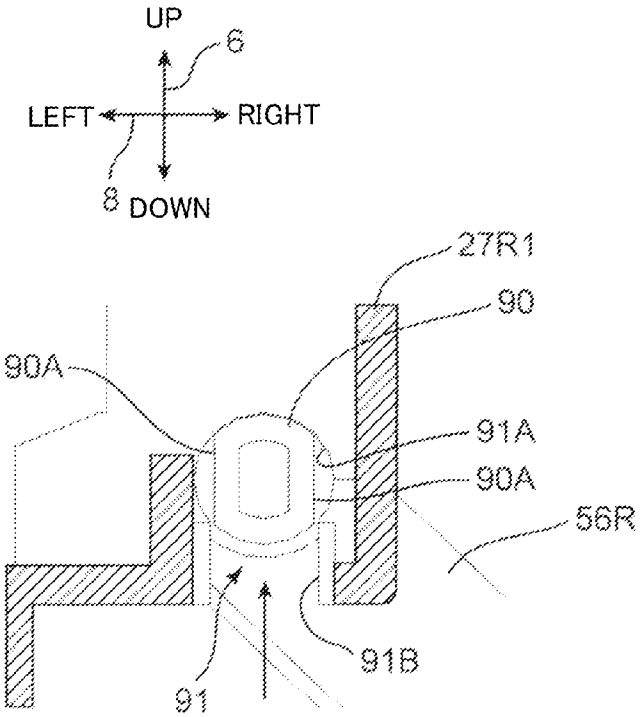
FIGS. 13A and 13B are views showing the state where, in the sheet feed device included in the image forming apparatus according to the third embodiment of the present disclosure, the outside cover is disposed at a predetermined rotational position.
Figure 13A:
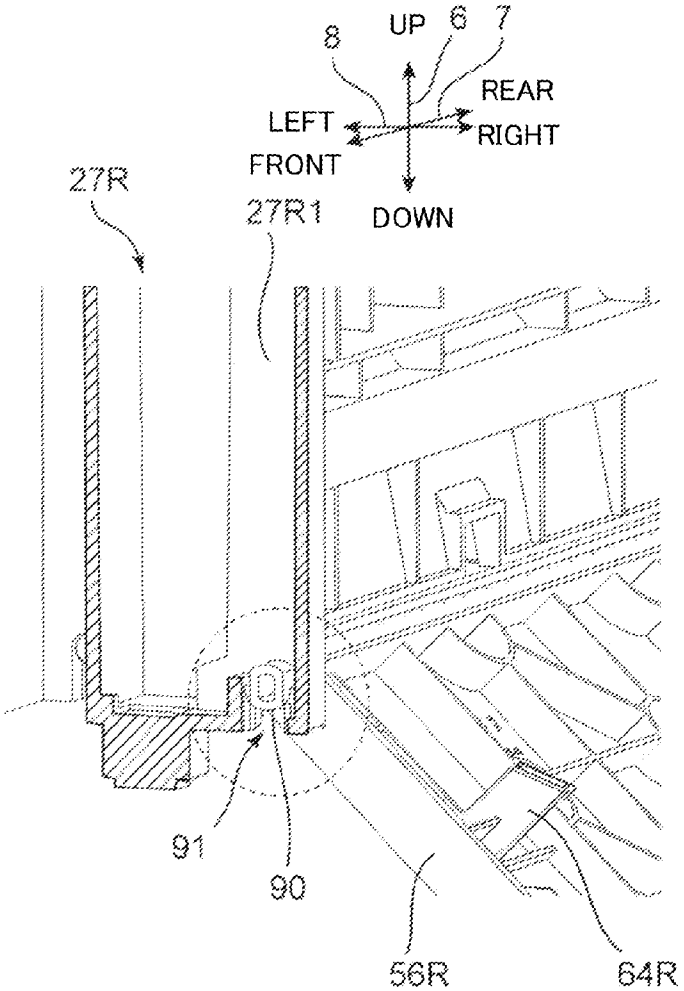
Figure 14B:
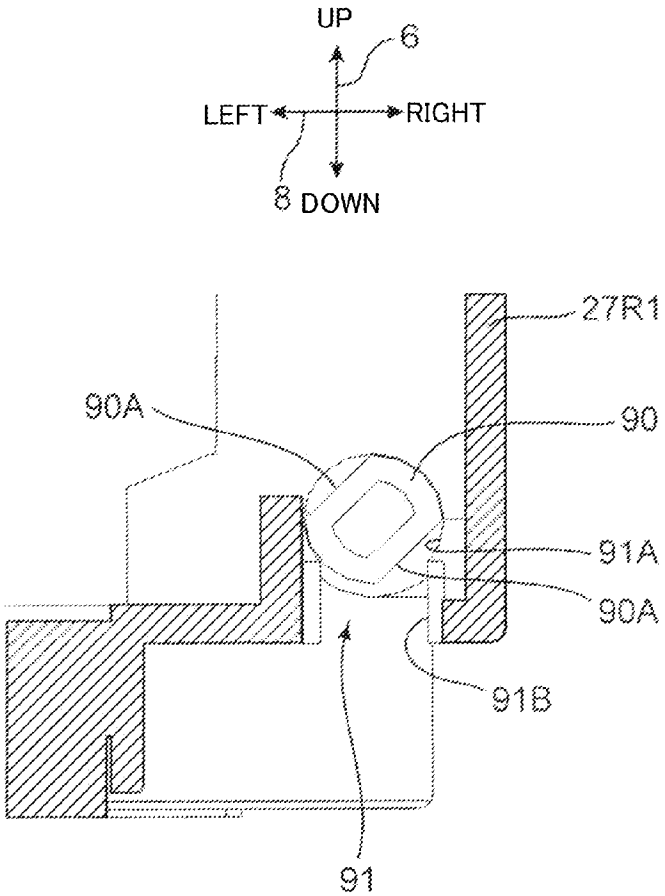
FIGS. 14A and 14B are views showing the state where, in the sheet feed device included in the image forming apparatus according to the third embodiment of the present disclosure, the outside cover is closed.
Figure 14A:
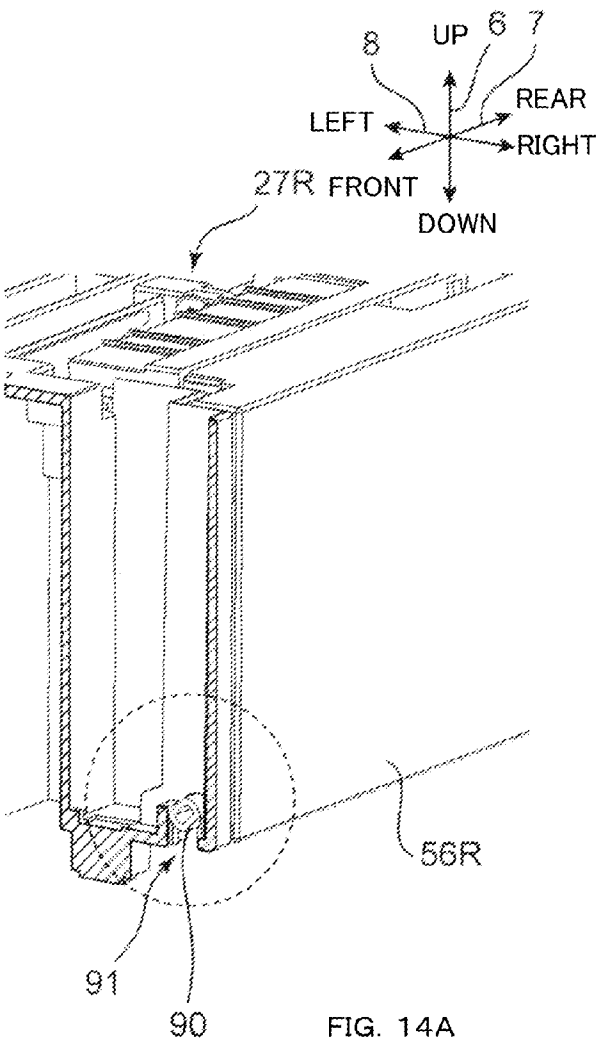
Figure 15:
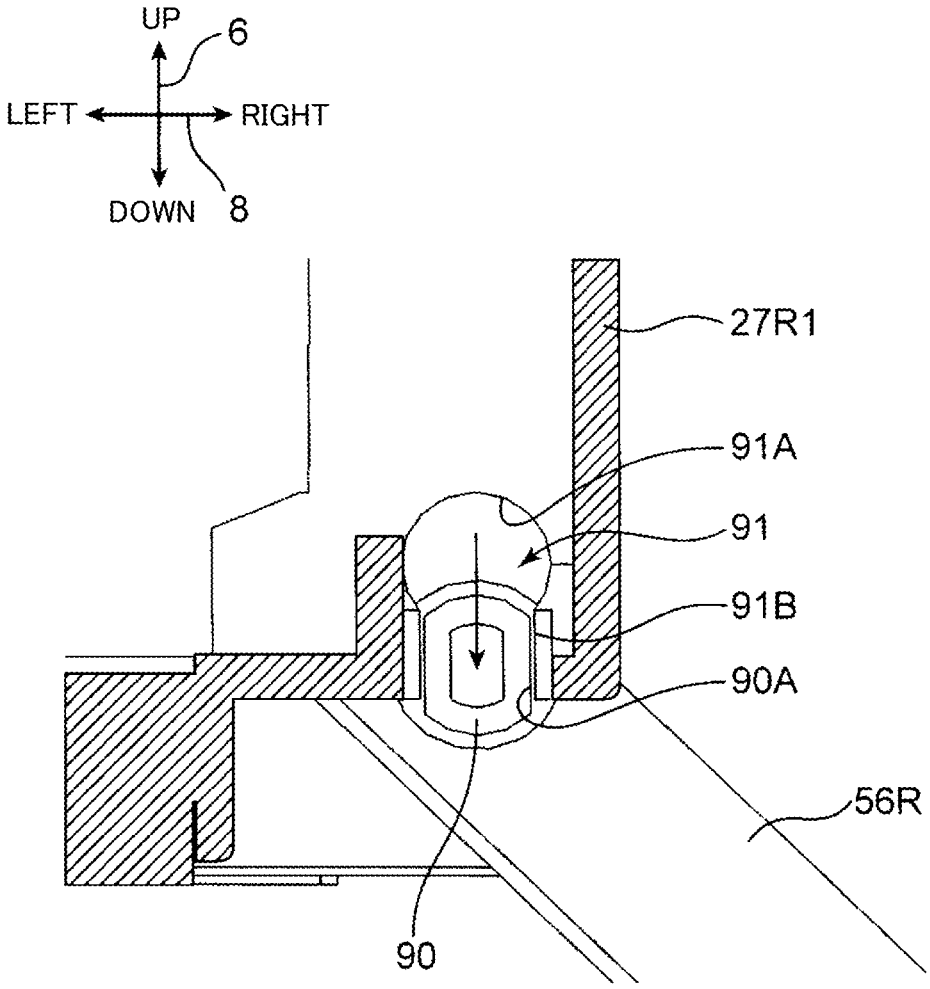
FIG. 15 is a cross-sectional view showing how, in the sheet feed device included in the image forming apparatus according to the third embodiment of the present disclosure, a shaft of the outside cover passes through an entrance of a bearing of the housing.

The following further explains about an image forming apparatus in a third embodiment of the present disclosure with reference to FIGS. 11 through 18. FIG. 11 is a perspective view showing the outside cover 56R of the image forming apparatus in the present embodiment. FIG. 12A is a perspective view of a frame portion of the sheet feed device 27R included in the image forming apparatus of the present embodiment, and FIG. 12B is a cross-sectional view of the frame portion. FIG. 13A is a cross-sectional perspective view in the state where, in the sheet feed device 27R, the outside cover 56R is at a predetermined position in the rotational movement, and FIG. 13B is a cross-sectional view thereof. FIG. 14A is a cross-sectional perspective view in the state where, in the sheet feed device 27R, the outside cover 56R is at the closing position, and FIG. 14B is a cross-sectional view thereof. FIG. 15 is a cross-sectional view showing how a cut surface 90A of a shaft 90 of the outside cover 56R passes through an entrance 91B of a bearing 91 in the sheet feed device 27R. It is noted that the present embodiment is different from the first embodiment in the configuration of the rotational movement of the outside cover 56R. Accordingly, the description is focused on this difference, and description of the configuration common to the first embodiment is omitted. It is also noted that, in the drawings of the present embodiment, character "R" attached to a reference number represents a member that has the same configuration and function as the corresponding member of the first embodiment.

Referring to FIG. 11, the outside cover 56R includes a pair of side walls 56R1 and a pair of shafts 90, as well as first locking pieces 63R and second locking pieces 64R. The side walls 56R1 are erected to face the front and the rear respectively and intersect with the right-side surface (side surface) of the housing (not shown) of the sheet feed device 27. It is noted that only a side wall 56R1 on the front side is shown in FIG. 11. The shafts 90 are members corresponding to the rotational shafts 61 of the first embodiment. That is, the shafts 90 project outward respectively from the side walls 56R1 in the axis direction of the rotational movement of the outside cover 56R, and become the fulcrum of the rotational movement of the outside cover 56R.

The shafts 90 include cut surfaces 90A respectively. Each cut surface 90A is a surface that is formed by cutting part of the circumferential surface of the shaft 90 along the axis direction. In the present embodiment, a pair of cut surfaces 90A are formed such that the two cut surfaces 90A are disposed to be separated from each other by 180 degrees in the circumferential direction, in other words, they are disposed to be opposite to each other in the radial direction. It is noted that the cut surfaces 90A may be formed by the cutting process of cutting the shafts 90 formed in the cylindrical shape into the shape of the cut surfaces 90A, or the shafts 90 having the cut surfaces 90A may be directly formed by the die molding. That is, the cut surfaces 90A are not limited to certain manufacturing methods, but are provided to define the shape.

Figure 12B:
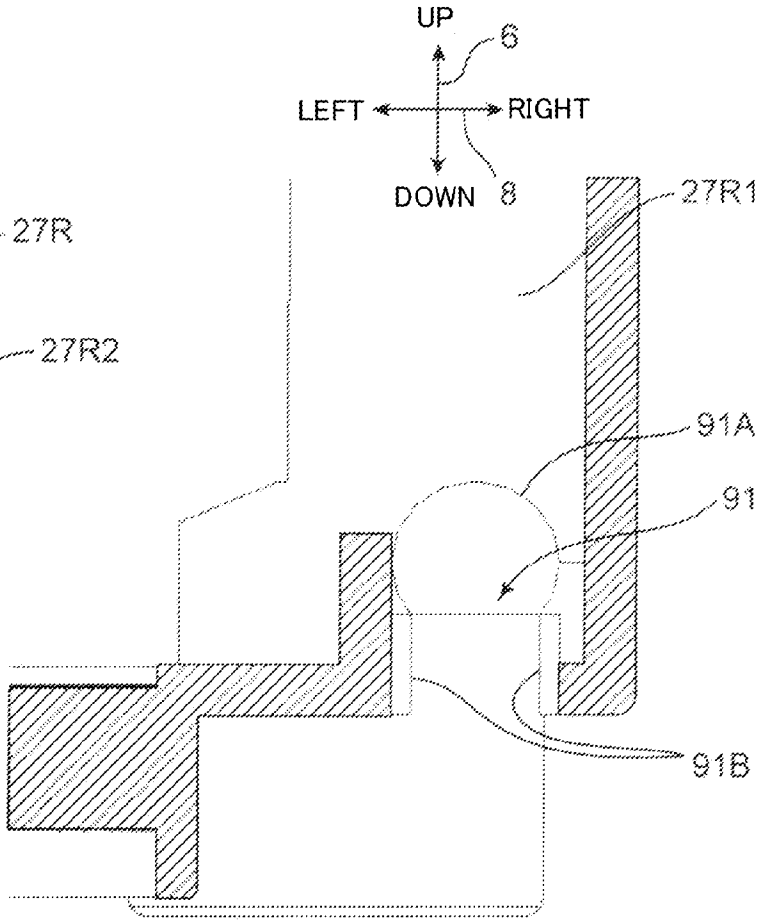
FIGS. 12A and 12B are views showing the housing of the sheet feed device included in the image forming apparatus according to the third embodiment of the present disclosure.
Figure 12A:
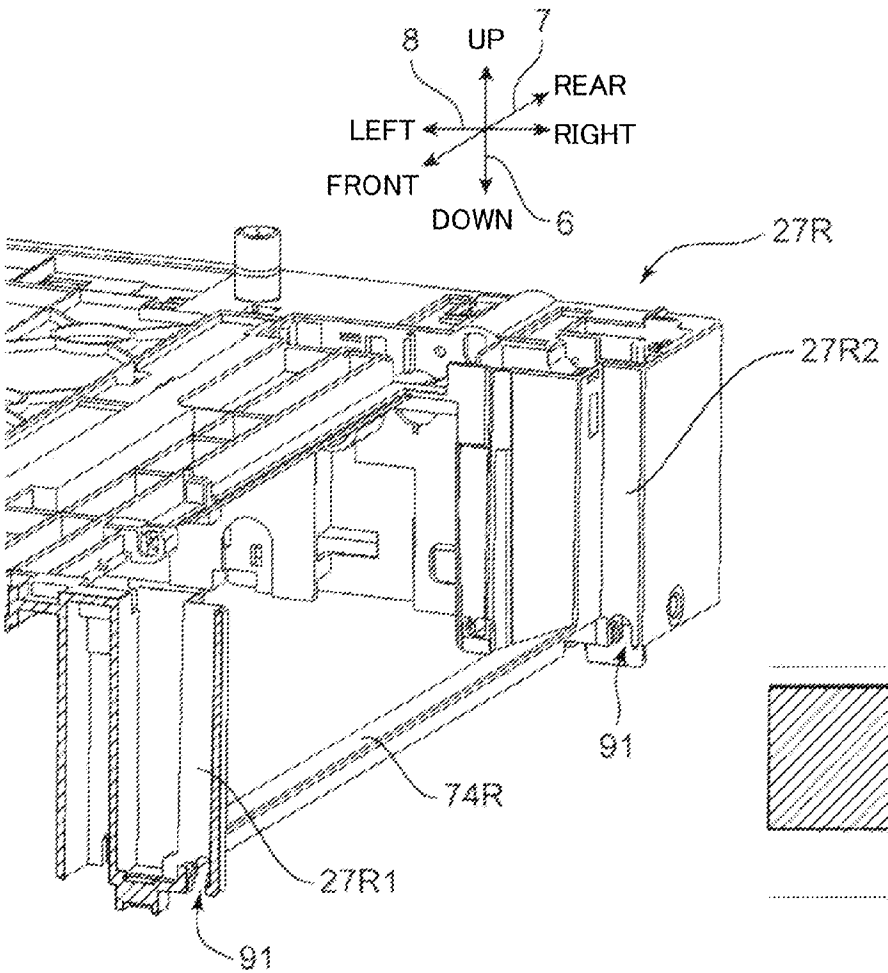

On the other hand, referring to FIGS. 12A and 12B, the sheet feed device 27R includes a front frame 27R1 and a rear frame 27R2. The front frame 27R1 and the rear frame 27R2 are a pair of frames that are disposed with a predetermined distance in the front-rear direction therebetween in the housing of the sheet feed device 27R. Between the front frame 27R1 and the rear frame 27R2, the outside cover 56R and an inside cover (not shown) are disposed. In addition, similar to the supporting portion 74 (see FIGS. 6A and 6B) of the first embodiment, a supporting portion 74R is extended from the front frame 27R1 to the rear frame 27R2 (see FIG. 12A). The sheet feed device 27R further includes a pair of bearings 91. The bearings 91 are a pair of bearings that are respectively disposed in the front frame 27R1 and the rear frame 27R2 to face the side walls 56R1 of the outside cover 56R. Each bearing 91 includes a shaft hole 91A and an entrance 91B (see FIG. 12B). The shaft hole 91A rotatably supports the shaft 90 of the outside cover 56R. The entrance 91B is a cut formed to communicate with the shaft hole 91A, and is formed by cutting the front frame 27R1 and the rear frame 27R2 partially from the lower edge of the shaft hole 91A downward. Each of the shafts 90 is configured to enter the entrance 91B from outside of the housing of the sheet feed device 27R, and pass through it.

In the present embodiment, cut positions of the cut surfaces 90A of the shafts 90 are set in advance such that the orientation of the cut surfaces 90A of the shafts 90 matches the orientation of the entrances 91B, at a rotational position (FIGS. 8B, 13A) at which the outside cover 56R is positioned after the outside cover 56R is rotationally moved from a first opening position, which corresponds to FIG. 7B, by a first angle around the shafts 90. With this configuration, as shown in FIGS. 13A and 13B, when the outside cover 56R is oriented to extend toward the lower right in the drawings, the cut surface 90A of the shaft 90 passes through the entrance 91B as indicated by the arrow in FIG. 13B, and the shaft 90 is supported by the bearing 91. That is, the entrance 91B allows for the shaft 90 having the cut surfaces 90A to pass therethrough and be attached to the bearing 91 such that the shaft 90 is supported by the bearing 91. When the outside cover 56R is rotationally moved anticlockwise from the state shown in FIG. 13B, the cut surface 90A is disposed to intersect with the entrance 91B as shown in FIGS. 14A and 14B, and the shaft 90 is prevented from dropping from the bearing 91. In this case where the outside cover 56R is attached to the bearings 91 of the sheet feed device 27R from a radial direction in the rotational movement, it is possible to set a smaller opening width between the front frame 27R1 and the rear frame 27R2, compared to a case where an outside cover is attached to a sheet feed device by being slided in the axis direction. In other words, in the case where the outside cover is slided to be attached, a gap remains between the outside cover 56 and the frame of the sheet feed device after the outside cover is attached, and this impairs the appearance of the sheet feed device.

On the other hand, with the configuration of the present embodiment, when the outside cover 56R is rotationally moved widely as shown in FIG. 8B of the first embodiment after the coupling between the second locking pieces 64R and the locked pieces 71 (see FIG. 7B) is released, the cut surfaces 90A of the shafts 90 are able to enter the entrances 91B of the bearings 91 again. As a result, when the outside cover 56R is opened widely by the user, the shafts 90 drop from the bearings 91 as indicated by the arrow in FIG. 15, and the outside cover 56R cannot be rotationally moved normally. Such a phenomenon is apt to occur particularly in the case where another sheet feed device is mounted below the sheet feed device 27R, and the outside cover and the inside cover of the lower sheet feed device are opened (see FIG. 9).

To solve this problem, in the present embodiment, the sheet feed device 27R includes a locking rib 92. FIG. 16A is a perspective view of the sheet feed device 27R viewed from below, and FIG. 16B an enlarged perspective view thereof. FIG. 17A is a perspective view showing how the outside cover 56R is opened in the sheet feed device 27R, and FIG. 17B is a cross-sectional view thereof.

Figure 16B:
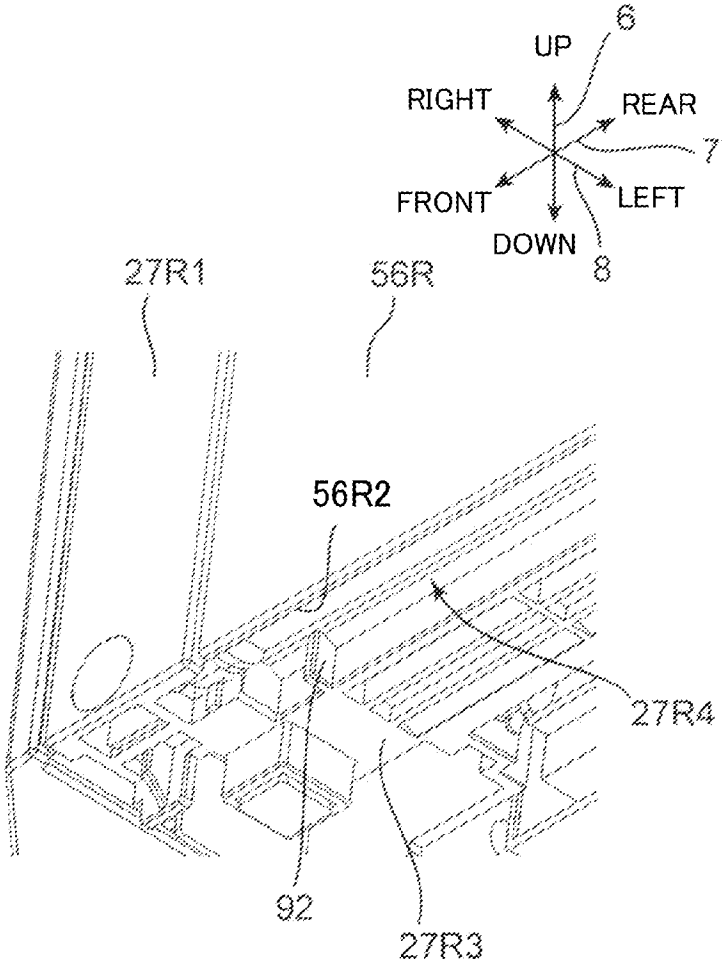
FIGS. 16A and 16B are views, viewed from below, of the sheet feed device included in the image forming apparatus according to the third embodiment of the present disclosure.
Figure 16A:
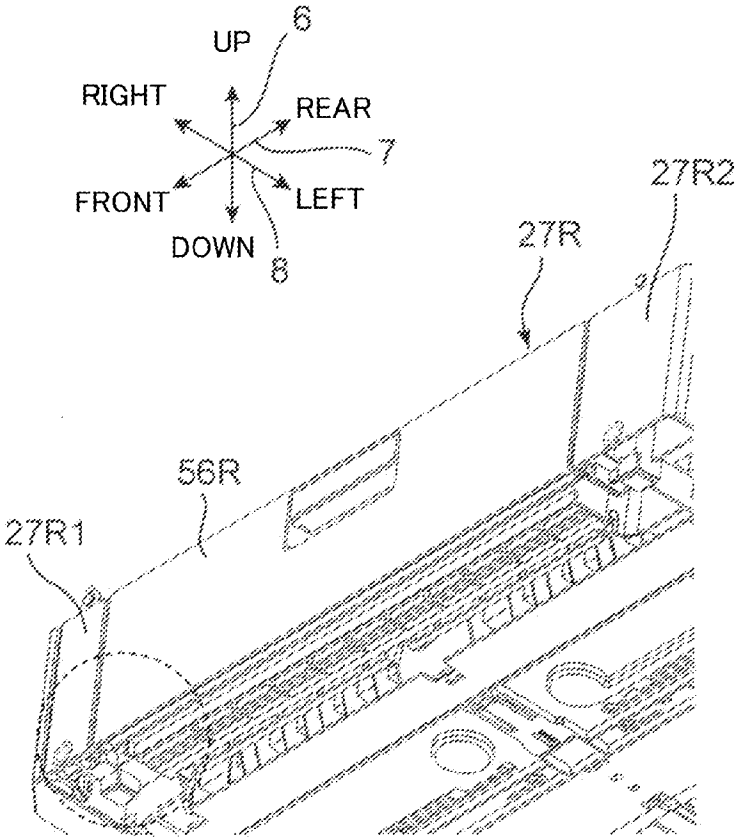

Referring to FIGS. 16A and 16B, the sheet feed device 27R includes a bottom 27R3. The bottom 27R3 includes, as a part thereof, the bottom of the paper sheet storing portion (see the paper sheet storing portion 22 of FIG. 3) attached to the sheet feed device 27R. In the right-side portion of the bottom 27R3 below the outside cover 56R, an entering space 27R4 is formed. The entering space 27R4 is a space into which a lower end 56R2 of the outside cover 56R enters as the outside cover 56R is rotationally moved. A locking rib 92 is a rib member disposed to face the front end of the entering space 27R4 in the bottom 27R3. The locking rib 92 is disposed in the rear side (lower surface) of the supporting portion 74R.

Figure 17B:
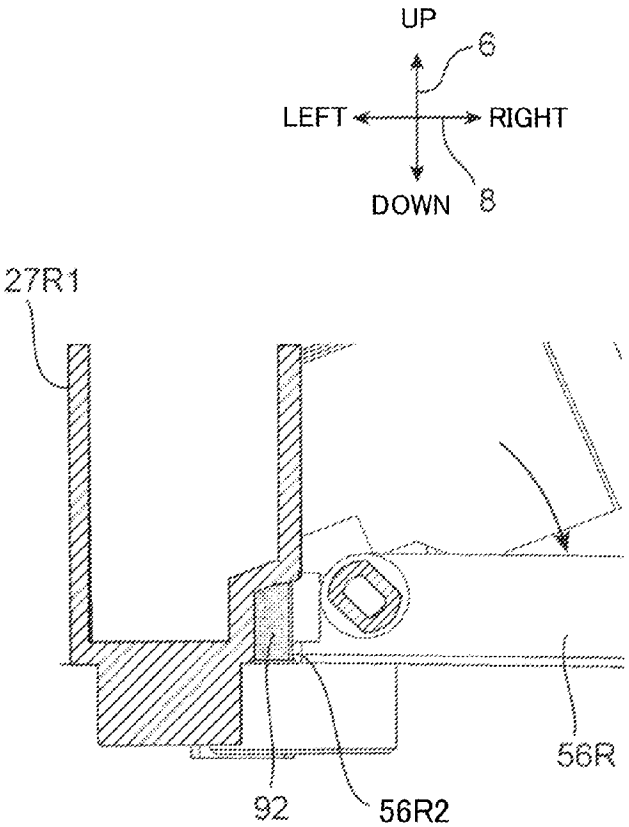
FIGS. 17A and 17B are views showing the state where, in the sheet feed device included in the image forming apparatus according to the third embodiment of the present disclosure, the outside cover is opened and abuts the restricting member.
Figure 17A:
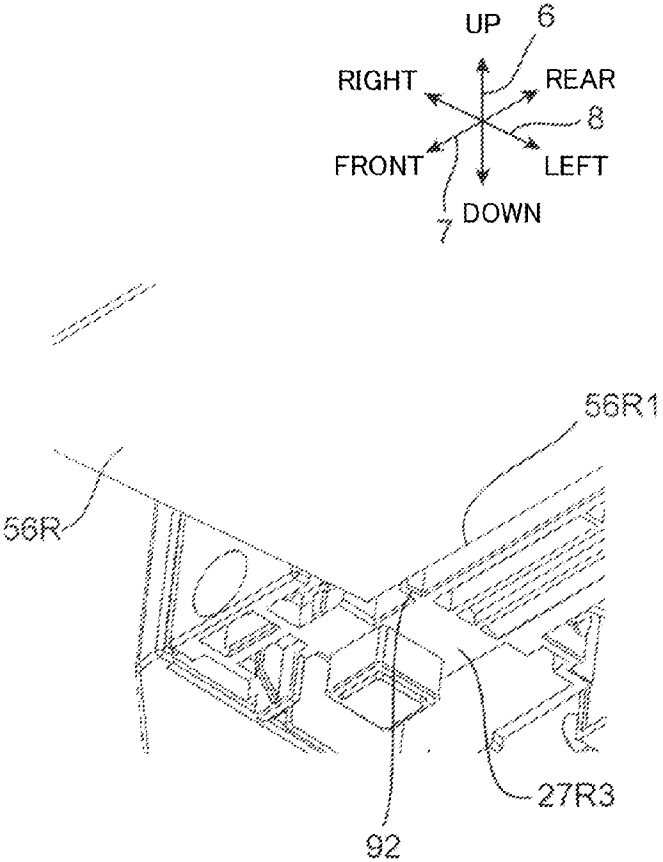

Referring to FIGS. 17A and 17B, when the outside cover 56R is further rotationally moved from the first opening position (see FIG. 7B) around the shafts 90 by a second angle which is smaller than the first angle (see the arrow shown in FIG. 17B), the locking rib 92 abuts the lower end 56R2 of the outside cover 56R. As a result, the locking rib 92 restricts the outside cover 56R from reaching the predetermined rotational position shown in FIG. 13B. Accordingly, the shafts 90 of the outside cover 56R are prevented from dropping downward from the bearings 91 after the coupling between the second locking pieces 64R and the locked pieces 71 (see FIG. 8A) is released.

Figure 18:
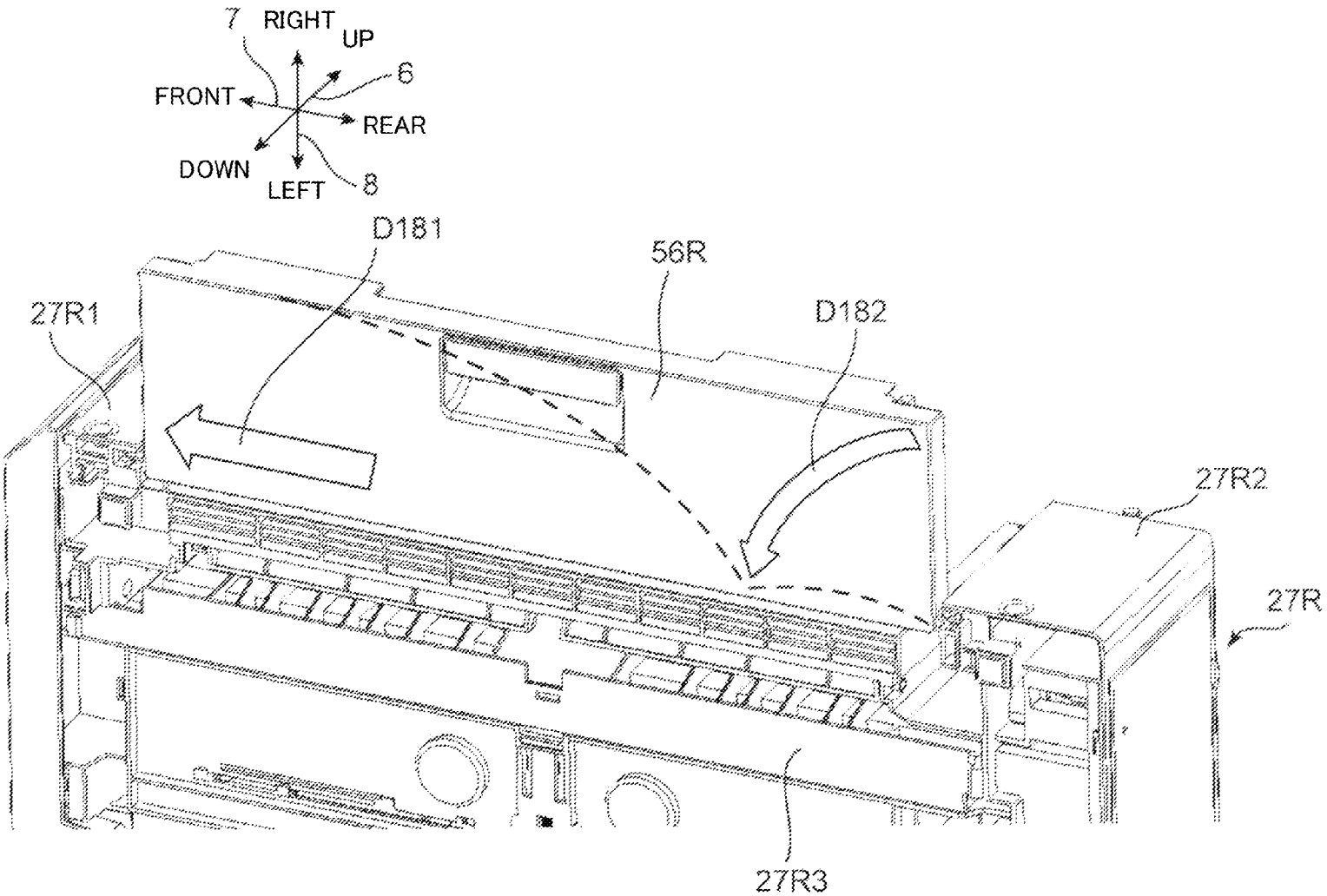
FIG. 18 is a perspective view showing how, in the sheet feed device included in the image forming apparatus according to the third embodiment of the present disclosure, the outside cover is attached to the sheet feed device.

FIG. 18 is a perspective view showing how the outside cover 56R is attached to the sheet feed device 27R in the image forming apparatus of the present embodiment. In the case where the locking rib 92 is provided as described above, the shafts 90 cannot be attached to the bearings 91 easily from below as shown in FIGS. 13A and 13B. That is, although the shaft 90 on the rear side can be inserted into the bearing 91 from below, the shaft 90 on the front side cannot be inserted into the bearing 91 from below because the locking rib 92 abuts the lower end 56R2. In view of this, in the present embodiment, the shaft 90 on the front side and the shaft 90 on the rear side are inserted into the bearings 91 in order.

The assembly worker of the sheet feed device 27R inserts the shaft 90 on the front side of the outside cover 56R into, from the rear, the shaft hole 91A of the bearin 91 formed in the front frame 27R1 (the arrow D181 shown in FIG. 18). At this time, the shaft 90 on the rear side may be disposed on the peripheral of the bearing 91 formed in the rear frame 27R2. In addition, as shown in FIG. 18, since the outside cover 56R is opened by approximately 90 degrees relative to the closing position, the lower end 56R2 of the outside cover 56R is disposed with a slight gap from the locking rib 92. Accordingly, as described above, it becomes possible to insert the shaft 90 into the bearing 91 in the axis direction.

In the posture of the outside cover 56R shown in FIG. 18, the cut surface 90A of the shaft 90 on the rear side is disposed to intersect with the entrance 91B of the bearing 91. Accordingly, in this state, the shaft 90 on the rear side cannot be attached to the bearing 91. As a result, the worker deforms the outside cover 56R such that the corner of the rear end portion of the outside cover 56R moves downward from the state shown in FIG. 18, as indicated by the arrow D182 shown in FIG. 18. At this time, the shaft 90 on the rear side is rotationally moved. It is noted that in the present embodiment too, the outside cover 56R is formed by the injection molding of synthetic resin, and thus the outside cover 56R can be deformed as described above. When the posture of the rear end portion of the outside cover 56R is changed as indicated by the broken line in FIG. 18, the cut surface 90A passes through the entrance 91B, and the shaft 90 on the rear side is attached to the bearing 91 as shown in FIG. 13B. After this, the worker returns the deformation of the outside cover 56R in a direction opposite to the arrow D182 of FIG. 18. This completes the attachment of the outside cover 56R. With this attachment, the outside cover 56R is rotatably supported by the housing of the sheet feed device 27R, and dropping of the outside cover 56R is prevented.

According to the above-described third embodiment, the cut surfaces 90A are provided respectively in the shafts 90 on the front and rear sides, and the entrances 91B are provided respectively in the bearings 91 on the front and rear sides. However, the present disclosure is not limited to this configuration. The cut surface 90A may be provided only in the shaft 90 on the rear side that is opposite to the locking rib 92, and the entrance 91B may be provided only in the bearing 91 on the rear side. In other words, the shaft 90 on the front side in the vicinity of the locking rib 92 may be cylindrical, and the bearing 91 on the front side may be composed of only the shaft hole 91A. In this case too, the worker can attach the outside cover 56R to the sheet feed device 27R by first inserting the shaft 90 on the front side into the bearing 91 as shown in FIG. 18, and then causing the cut surface 90A of the shaft 90 on the rear side to pass through the entrance 91B. This configuration also prevents the outside cover 56R from dropping by mistake. Furthermore, the present disclosure is not limited to the manner in which a pair of cut surfaces 90A are formed in the shafts 90, but only a part of the circumferential surface of each shaft 90 may be cut. In that case, the shape of the entrances 91B of the bearings 91 may be adjusted appropriately. The restricting member of the present disclosure, an example of which is the locking rib 92, is not limited to the rib shape, but may be other protruding shapes. Furthermore, the restricting member may be disposed on the outside cover 56R side.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. A sheet feed device comprising:

a housing having a side;

a sheet storing portion configured to store one or more sheet members;

a conveyance path formed inside the housing and configured to guide a sheet member conveyed from the sheet storing portion;

an outside cover having a first rotational shaft at a lower end thereof and rotatably supported with the first rotational shaft as a fulcrum by the housing, and configured to be positioned at a first closing position to close the side of the housing, and at a first opening position to open the side of the housing;

an inside cover disposed more inside of the housing than the outside cover, having, at a lower end thereof, a second rotational shaft that is disposed more inside of the housing than the first rotational shaft of the outside cover, rotatably supported with the second rotational shaft as a fulcrum by the housing, and configured to be rotationally moved between a second closing position at which to close the conveyance path when the outside cover is at the first closing position, and a second opening position at which to expose the conveyance path when the outside cover is at the first opening position;

a coupled portion provided on the inside cover and configured to be coupled with the outside cover;

a first coupling portion provided on the outside cover and configured to, when the outside cover is rotationally moved in an opening direction from the first closing position toward the first opening position, be coupled with the coupled portion and cause the inside cover to be rotationally moved toward the second opening position, and after the inside cover starts to be rotationally moved toward the second opening position, release coupling with the coupled portion; and a second coupling portion provided on the outside cover and configured to, when the outside cover is further rotationally moved toward the first opening position after the first coupling portion releases the coupling with the coupled portion, be coupled with the coupled portion and hold the outside cover at the first opening position, wherein the coupled portion includes a first locking claw bending from a tip of an arm in an axis direction of the fulcrum of the inside cover, the arm projecting from a surface of the inside cover at the second closing position facing the outside cover, and wherein each of the first coupling portion and the second coupling portion includes a second locking claw bending from a tip of an arm in a direction that faces the first locking claw, and configured to be locked to the first locking claw of the coupled portion, the arm projecting from a surface of the outside cover at the first closing position facing the inside cover.

2. The sheet feed device according to claim 1, wherein a contact surface of the second locking claw, which contacts the first locking claw when the second locking claw is locked to the first locking claw, is inclined toward the fulcrum of the outside cover with reference to the surface of the outside cover facing the inside cover.

3. The sheet feed device according to claim 1, further comprising a supporting portion configured to support the inside cover at the second opening position by abutting a lower surface of the inside cover.

4. The sheet feed device according to claim 1, wherein the second coupling portion is positioned more on the side of the fulcrum of the outside cover than the first coupling portion.

5. The sheet feed device according to claim 1, wherein at least one of the outside cover at the first closing position and the inside cover at the second closing position constitutes a guide surface of the conveyance path.

6. The sheet feed device according to claim 1, wherein when an external force, which is stronger than a coupling force between the second coupling portion and the coupled portion, is applied in the opening direction to the outside cover held at the first opening position, the coupling between the second coupling portion and the coupled portion is released.

7. The sheet feed device according to claim 6, wherein the first rotational shaft of the outside cover comprises a pair of shafts configured to function as the fulcrum of the outside cover, the housing includes a pair of bearings, which includes shaft holes configured to rotatably support the shafts, at least one of the pair of shafts includes a cut surface formed by cutting part of circumferential surface of the shaft along the axis direction, at least one of the pair of bearings that supports the at least one of the pair of shafts includes an entrance that is formed to communicate with the shaft hole rotatably supporting the at least one of the pair of shafts, and is configured to allow for the at least one of the pair of shafts to pass therethrough and be attached to the shaft hole via the entrance when orientation of the cut surface of the at least one of the pair of shafts matches orientation of the entrance.

8. The sheet feed device according to claim 7, wherein a cut position of the cut surface of the at least one of the pair of shafts and a position of the entrance are set in advance such that the orientation of the cut surface of the at least one of the pair of shafts matches the orientation of the entrance, at a rotational position at which the outside cover is positioned when the outside cover is rotationally moved from the first opening position by a first angle around the shafts after the coupling between the second coupling portion and the coupled portion is released, and the sheet feed device further comprises a restricting member configured to, when the outside cover is further rotationally moved from the first opening position around the shafts by a second angle which is smaller than the first angle, abut the outside cover and restrict the outside cover from reaching the rotational position.

9. The sheet feed device according to claim 8, wherein the restricting member is a rib member that is disposed in the housing and is configured to abut a lower end of the outside cover.

10. An image forming apparatus comprising:

a housing having a side;

an outside cover having a first rotational shaft at a lower end thereof and rotatably supported with the first rotational shaft as a fulcrum by the housing, and configured to be positioned at a first closing position to close the side of the housing, and at a first opening position to open the side of the housing;

an inside cover disposed more inside of the housing than the outside cover, having, at a lower end thereof, a second rotational shaft that is disposed more inside of the housing than the first rotational shaft of the outside cover, rotatably supported with the second rotational shaft as a fulcrum by the housing, and configured to be rotationally moved between a second closing position at which to close inside of the housing when the outside cover is at the first closing position, and a second opening position at which to open the inside of the housing when the outside cover is at the first opening position;

a coupled portion provided on the inside cover and configured to be coupled with the outside cover;

a first coupling portion provided on the outside cover and configured to, when the outside cover is rotationally moved in an opening direction from the first closing position toward the first opening position, be coupled with the coupled portion and cause the inside cover to be rotationally moved toward the second opening position, and after the inside cover starts to be rotationally moved toward the second opening position, release coupling with the coupled portion; and a second coupling portion provided on the outside cover and configured to, when the outside cover is further rotationally moved toward the first opening position after the first coupling portion releases the coupling with the coupled portion, be coupled with the coupled portion and hold the outside cover at the first opening position, wherein the coupled portion includes a first locking claw bending from a tip of an arm in an axis direction of the fulcrum of the inside cover, the arm projecting from a surface of the inside cover at the second closing position facing the outside cover, and wherein each of the first coupling portion and the second coupling portion includes a second locking claw bending from a tip of an arm in a direction that faces the first locking claw, and configured to be locked to the first locking claw of the coupled portion, the arm projecting from a surface of the outside cover at the first closing position facing the inside cover.

11. The image forming apparatus according to claim 10, wherein a contact surface of the second locking claw, which contacts the first locking claw when the second locking claw is locked to the first locking claw, is inclined toward the fulcrum of the outside cover with reference to the surface of the outside cover facing the inside cover.

12. The image forming apparatus according to claim 10, further comprising a supporting portion configured to support the inside cover at the second opening position by abutting a lower surface of the inside cover.

13. The image forming apparatus according to claim 10, wherein the second coupling portion is positioned more on the side of the fulcrum of the outside cover than the first coupling portion.

14. The image forming apparatus according to claim 10, further comprising:

a sheet storing portion configured to store one or more sheet members used for image formation; and a conveyance path configured to guide a sheet member conveyed from the sheet storing portion, wherein at least one of the outside cover at the first closing position and the inside cover at the second closing position constitutes a guide surface of the conveyance path.

15. The image forming apparatus according to claim 10, wherein when an external force, which is stronger than a coupling force between the second coupling portion and the coupled portion, is applied in the opening direction to the outside cover held at the first opening position, the coupling between the second coupling portion and the coupled portion is released.

16. The image forming apparatus according to claim 15, wherein the first rotational shaft of the outside cover comprises a pair of shafts configured to function as the fulcrum of the outside cover, the housing includes a pair of bearings, which includes shaft holes configured to rotatably support the shafts, at least one of the pair of shafts includes a cut surface formed by cutting part of circumferential surface of the shaft along the axis direction, at least one of the pair of bearings that supports the at least one of the pair of shafts includes an entrance that is formed to communicate with the shaft hole rotatably supporting the at least one of the pair of shafts, and is configured to allow for the at least one of the pair of shafts to pass therethrough and be attached to the shaft hole via the entrance when orientation of the cut surface of the at least one of the pair of shafts matches orientation of the entrance.

17. The image forming apparatus according to claim 16, wherein a cut position of the cut surface of the at least one of the pair of shafts and a position of the entrance are set in advance such that the orientation of the cut surface of the at least one of the pair of shafts matches the orientation of the entrance, at a rotational position at which the outside cover is positioned when the outside cover is rotationally moved from the first opening position by a first angle around the shafts after the coupling between the second coupling portion and the coupled portion is released, and the image forming apparatus further comprises a restricting member configured to, when the outside cover is further rotationally moved from the first opening position around the shafts by a second angle which is smaller than the first angle, abut the outside cover and restrict the outside cover from reaching the rotational position.

18. The image forming apparatus according to claim 17, wherein the restricting member is a rib member that is disposed in the housing and is configured to abut a lower end of the outside cover.

* * * * *